US010989459B2

(12) United States Patent
Chandra et al.

(10) Patent No.: US 10,989,459 B2
(45) Date of Patent: Apr. 27, 2021

(54) REFRIGERATOR APPLIANCE AND ICE DISPENSER DEFINING A LIQUID OUTLET

(71) Applicant: Haier US Appliance Solutions, Inc., Wilmington, DE (US)

(72) Inventors: Sharath Chandra, Hyderabad (IN); Joshna Konudula, Hyderabad (IN); Allamneni Naga Tejaswini, Hyderabad (IN); Koncha Chandra Sekhar, Hyderabad (IN); Andrew Reinhard Krause, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 166 days.

(21) Appl. No.: 16/010,555

(22) Filed: Jun. 18, 2018

(65) Prior Publication Data

US 2019/0383543 A1 Dec. 19, 2019

(51) Int. Cl.

| | |
|---|---|
| ***F25C 5/20*** | (2018.01) |
| ***F25D 23/12*** | (2006.01) |
| ***F25D 27/00*** | (2006.01) |

(52) U.S. Cl.

CPC ..... *F25C 5/22* (2018.01); *F25D 23/126* (2013.01); *F25D 27/005* (2013.01); *F25D 2327/001* (2013.01); *F25D 2700/04* (2013.01)

(58) Field of Classification Search

CPC ..... F25C 1/04; F25C 5/22; F25C 2400/14; F25D 27/005; F25D 2700/04;

(Continued)

(56) References Cited

U.S. PATENT DOCUMENTS 4,123,918 A * 11/1978 Kohl ..... F25C 5/24 62/320
4,276,750 A * 7/1981 Kawasumi ..... B67D 1/00 62/137

(Continued)

FOREIGN PATENT DOCUMENTS

| | | |
|---|---|---|
| CN | 101000200 | 7/2007 |
| CN | 102305514 | 1/2012 |

(Continued)

OTHER PUBLICATIONS

International Search Report, PCT Application No. PCT/CN2019/091455, dated Sep. 16, 2019, 5 pages.

*Primary Examiner* — Frantz F Jules
*Assistant Examiner* — Martha Tadesse
(74) *Attorney, Agent, or Firm* — Dority & Manning, P.A.

(57) ABSTRACT

A refrigerator appliance and ice dispenser is provided herein. The refrigerator appliance may include a cabinet, an ice maker attached to the cabinet, a dispenser recess defined on the refrigerator appliance, and a dispenser conduit disposed within the dispenser recess. The dispenser conduit may include a chute wall. The chute wall may define an ice passage, one or more fluid inlets, a manifold channel, and one or more fluid outlets. A fluid inlet may be positioned radially outward from the ice passage in fluid communication with a fluid source selectively supplying a fluid flow thereto. The manifold channel may extend within the chute wall about at least a portion of the ice passage. The manifold channel may be in downstream fluid communication with the fluid inlet. A fluid outlet may be defined through the chute wall in downstream fluid communication with the manifold channel.

20 Claims, 21 Drawing Sheets

(58) Field of Classification Search
CPC .. F25D 2327/001; F25D 11/02; F25D 23/025; F25D 2700/121; F25D 3/045; F25D 23/02; F25D 23/068
See application file for complete search history.

(56) References Cited

U.S. PATENT DOCUMENTS

| | | | | |
|---|---|---|---|---|
| 5,526,854 | A * | 6/1996 | Unger | F25C 5/22 141/351 |
| 7,007,500 | B2 * | 3/2006 | Lee | F25C 5/005 222/146.6 |
| 7,111,473 | B2 * | 9/2006 | Chung | F25C 5/007 241/DIG. 17 |
| 7,210,601 | B2 | 5/2007 | Hortin et al. | |
| 7,874,460 | B2 * | 1/2011 | Jang | F25C 5/02 222/146.6 |
| 7,942,016 | B2 * | 5/2011 | Johnson | F25C 5/22 62/340 |
| 8,240,159 | B2 * | 8/2012 | Prabhakar | F25D 23/028 62/115 |
| 8,955,350 | B2 * | 2/2015 | Nuss | F25C 5/22 62/320 |
| 9,057,556 | B2 | 6/2015 | Ashrafzadeh et al. | |
| 9,073,743 | B2 * | 7/2015 | Sanchez | B67D 1/0889 |
| 9,243,841 | B2 | 1/2016 | Lu et al. | |
| 9,506,682 | B2 * | 11/2016 | Yun | B67D 1/0014 |
| 10,502,477 | B2 * | 12/2019 | Miller | F25D 21/14 |
| 2004/0187516 | A1 * | 9/2004 | Lee | F25C 5/22 62/389 |
| 2008/0163641 | A1 | 7/2008 | Mitchell | |
| 2010/0313595 | A1 * | 12/2010 | Seo | F25C 5/22 62/344 |
| 2011/0174008 | A1 * | 7/2011 | Kim | F25D 23/126 62/264 |
| 2012/0103000 | A1 | 5/2012 | Krause | |
| 2014/0270725 | A1 * | 9/2014 | Bertolini | B67D 7/82 392/341 |
| 2014/0299628 | A1 | 10/2014 | Gormley et al. | |
| 2015/0276293 | A1 * | 10/2015 | Seo | F25C 5/22 222/1 |
| 2016/0025399 | A1 * | 1/2016 | Miller | F25D 21/14 62/344 |
| 2016/0327326 | A1 * | 11/2016 | Mitchell | F25D 23/025 |
| 2016/0341462 | A1 * | 11/2016 | Kim | F25D 23/04 |

FOREIGN PATENT DOCUMENTS

| | | | |
|---|---|---|---|
| CN | 106168425 | | 11/2016 |
| CN | 205671937 | | 11/2016 |
| CN | 205671937 U | * | 11/2016 |
| CN | 206600975 | | 10/2017 |
| CN | 206600975 U | * | 10/2017 |

* cited by examiner

REFRIGERATOR APPLIANCE AND ICE DISPENSER DEFINING A LIQUID OUTLET

FIELD OF THE INVENTION

The present subject matter relates generally to refrigerator appliances and ice dispensers for refrigerator appliances.

BACKGROUND OF THE INVENTION

Dispensers for liquids or ice are typically provided in refrigeration appliances, such as refrigerators, freezers, and vending machines. In certain of such appliances, both hot and cold water may be provided. Moreover, in some appliances, coffee or other beverages may be dispensed as well. Often, these dispensers include some sort of recess or compartment into which a container or vessel, such as a cup, is placed to receive the dispensed substance.

In many instances, a conduit for dispensing liquids extends downward into a dispenser recess. As an example, a liquid conduit may extend in front of or behind an ice nozzle. Such configurations may be unsightly and aesthetically unappealing to users. Moreover, they may complicate assembly and, in some conditions, interfere with the movement of ice through the ice nozzle (e.g., by blocking a portion of the passage of the ice nozzle or restricting movement of the ice nozzle). It may be desirable to selectively change or vary the characteristics of the liquids dispensed through the conduit. For example, containers of different sizes may be easier to fill if the spray angle or flow rate from conduit is varied. However, incorporating additional liquid conduits may exasperate the above-described issues.

In additional or alternative instances, lighting may be provided for the dispenser compartment to assist the user in placing the container so as to receive the dispensed substance. Typically, such lighting is an incandescent bulb placed in a top portion of the compartment. While such a bulb will generally illuminate the compartment sufficiently, the bulb does not provide much information to a user.

Accordingly, a refrigerator having a dispenser assembly incorporating features addressing one or more of the above-described issues would be useful. In particular, it would be advantageous for a dispenser assembly to include features for improving liquid dispensing or lighting at an ice dispenser.

BRIEF DESCRIPTION OF THE INVENTION

Aspects and advantages of the invention will be set forth in part in the following description, or may be obvious from the description, or may be learned through practice of the invention.

In exemplary aspects of the present disclosure, a refrigerator appliance is provided. The refrigerator appliance may include a cabinet, an ice maker attached to the cabinet, a dispenser recess defined on the refrigerator appliance in selective communication with the ice maker, and a dispenser conduit disposed within the dispenser recess. The dispenser conduit may include a chute wall. The chute wall may define an ice passage permitting ice therethrough, a fluid inlet, a manifold channel, and a plurality of discrete fluid outlets. The fluid inlet may be positioned radially outward from the ice passage in fluid communication with a fluid source selectively supplying a fluid flow thereto. The manifold channel may extend within the chute wall about at least a portion of the ice passage. The manifold channel may be in downstream fluid communication with the fluid inlet. The plurality of discrete fluid outlets may be defined through the chute wall in downstream fluid communication with the manifold channel. The plurality of discrete fluid outlets may be circumferentially spaced apart along the manifold channel.

In other exemplary aspects of the present disclosure, a refrigerator appliance is provided. The refrigerator appliance may include a cabinet, an ice maker attached to the cabinet, a dispenser recess defined on the refrigerator appliance in selective communication with the ice maker, a dispenser conduit disposed within the dispenser recess, and a light source. The dispenser conduit may include a chute wall. The chute wall may define an ice passage permitting ice therethrough, a fluid inlet, and a fluid outlet. The fluid inlet may be positioned radially outward from the ice passage in fluid communication with a fluid source selectively supplying a fluid flow thereto. The fluid outlet may be defined through the chute wall in downstream fluid communication with the fluid inlet. The light source may be mounted within the chute wall and directed toward the dispenser recess.

In still other exemplary aspects of the present disclosure, a refrigerator appliance is provided. The refrigerator appliance may include a cabinet, an ice maker attached to the cabinet, a dispenser recess defined on the refrigerator appliance in selective communication with the ice maker, and a dispenser conduit disposed within the dispenser recess. The dispenser conduit may include a chute wall. The chute wall may define an ice passage permitting ice therethrough, a first fluid inlet, a first fluid outlet, a second fluid inlet, and a second fluid outlet. The first fluid inlet may be positioned radially outward from the ice passage in fluid communication with a fluid source selectively supplying a fluid flow thereto. The first fluid outlet may be defined through the chute wall in downstream fluid communication with the first fluid inlet. The second fluid inlet may be positioned radially outward from the ice passage in fluid parallel to the first fluid inlet. The second fluid outlet may be in downstream fluid communication with the second fluid inlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
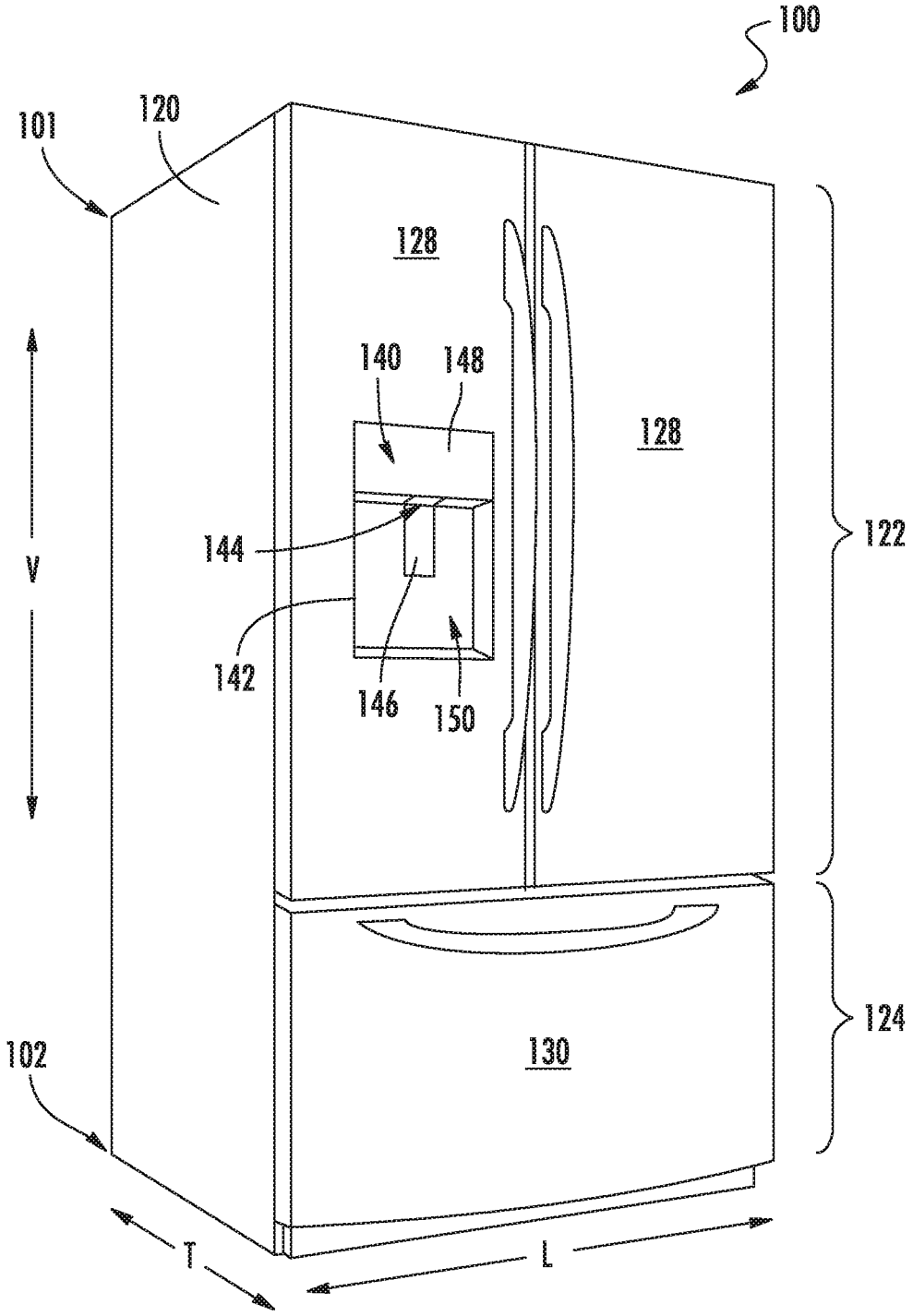
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both," except as otherwise indicated).

FIG. 1 provides a perspective view of a refrigerator appliance 100 according to an exemplary embodiment of the present disclosure. Refrigerator appliance 100 includes a cabinet or housing 120 that defines a vertical direction V, a lateral direction L, and a transverse direction T. The vertical direction V, lateral direction L, and transverse direction are all mutually perpendicular and form an orthogonal direction system. Housing 120 extends between a top 101 and a bottom 102 along a vertical direction V. Housing 120 defines chilled chambers for receipt of food items for storage. In particular, housing 120 defines a fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 may be coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water or ice. Dispensing assembly 140 includes a dispenser 142 positioned on or mounted to an exterior portion of refrigerator appliance 100 (e.g., on one of doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs, such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150, defined at least partially by a dispenser back wall 152. Dispenser recess 150 is defined at a predetermined elevation convenient for a user to access ice or water and enabling the user to access ice without the need to bend-over and without the need to open doors 120. In the exemplary embodiment, dispenser recess 150 is positioned at a level that approximates the chest level of a user.

In exemplary embodiments may include a processing device or controller 190 operably coupled to (e.g., in wireless or electrical communication with) one or more portions of ice making assembly 160 or dispensing assembly 140. In some such embodiments, operation of ice making assembly 160 or dispensing assembly 140 is controlled by controller 190, as will be described below. For example, controller 190 may be operably coupled to control panel 148 for user or automatic selection of certain features and operations of ice making assembly 160 or dispensing assembly 140.

Controller 190 includes memory (e.g., non-transitive memory) and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. For certain embodiments, the instructions include a software package configured to operate appliance 100. The memory can be a separate component from the processor or can be included onboard within the processor. Alternatively, controller 190 may be constructed without using a microprocessor, for example, using a combination of discrete analog or digital logic circuitry (such as switches, amplifiers, integrators, comparators, flip-flops, AND gates, and the like) to perform control functionality instead of relying upon software.

Figure 2:
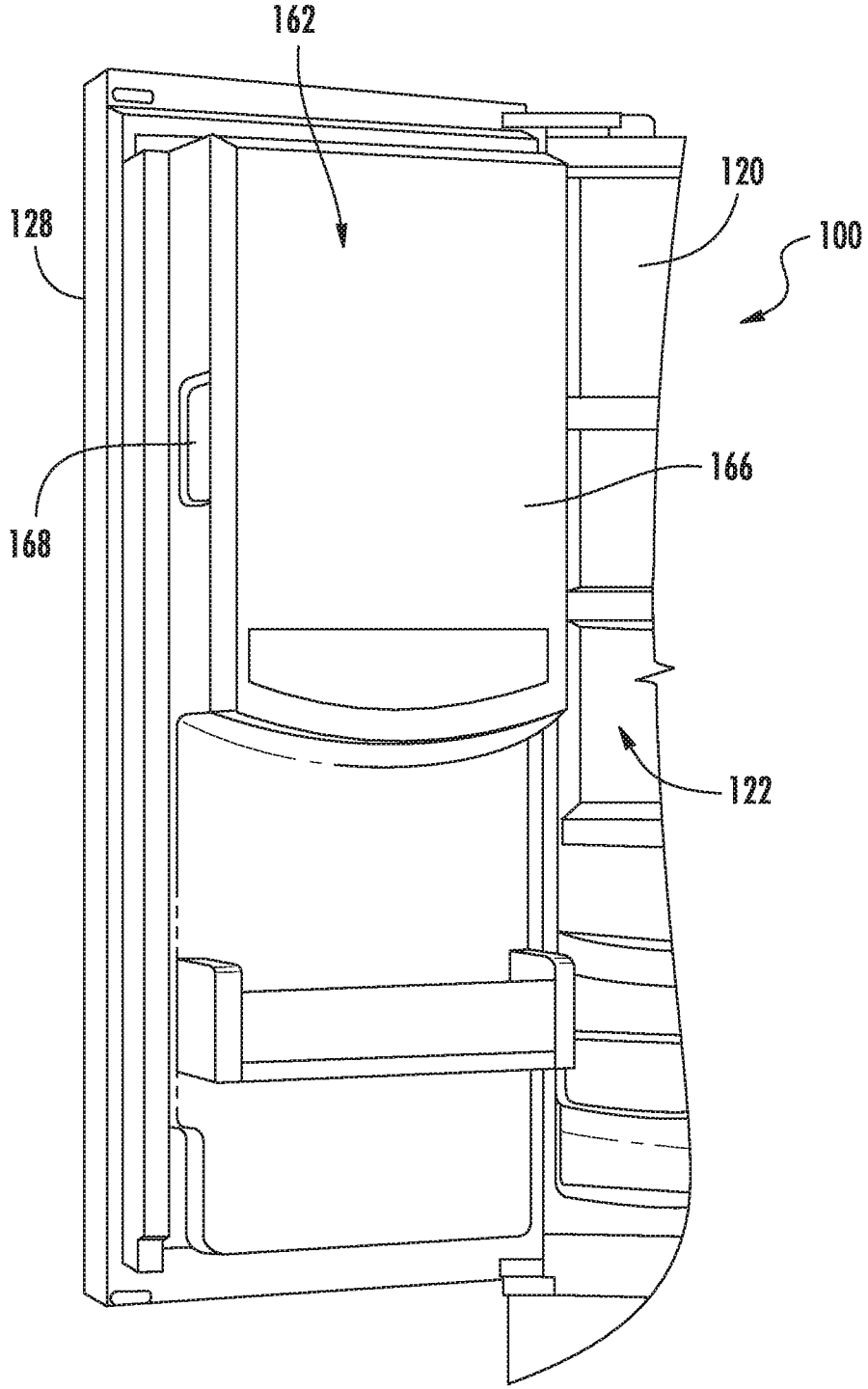
FIG. 2 provides a perspective view of a refrigerator door of the exemplary refrigerator appliance of FIG. 1.

FIG. 2 provides a perspective view of a door of refrigerator doors 128. Refrigerator appliance 100 includes a sub-compartment 162 defined on refrigerator door 128. Sub-compartment 162 is often referred to as an "icebox." Sub-compartment 162 extends into fresh food chamber 122 when refrigerator door 128 is in the closed position. Additionally or alternatively, icebox compartment 162 may be defined within door 130 and extend into freezer chamber 124.

In certain embodiments, an ice maker or ice making assembly 160 and an ice storage bin 164 (FIG. 3) are positioned or disposed within sub-compartment 162. Thus, ice is supplied to dispenser recess 150 (FIG. 1) from the ice making assembly 160 or ice storage bin 164 in sub-compartment 162 on a back side of refrigerator door 128. Chilled air from a sealed system (not shown) of refrigerator appliance 100 may be directed into sub-compartment 162 in order to cool ice making assembly 160 or ice storage bin 164. In alternative exemplary embodiments, a temperature of air within sub-compartment 162 may correspond to a temperature of air within fresh food chamber 122, such that ice within ice storage bin 164 melts over time.

An access door 166 may be hinged to refrigerator door 128. Access door 166 permits selective access to freezer sub-compartment 162. Any manner of suitable latch 168 is included with freezer sub-compartment 162 to maintain access door 166 in a closed position. As an example, latch 168 may be actuated by a consumer in order to open access door 166 for providing access into freezer sub-compartment 162. Access door 166 can also assist with insulating freezer sub-compartment 162, e.g., by thermally isolating or insulating freezer sub-compartment 162 from fresh food chamber 122.

Figure 3:
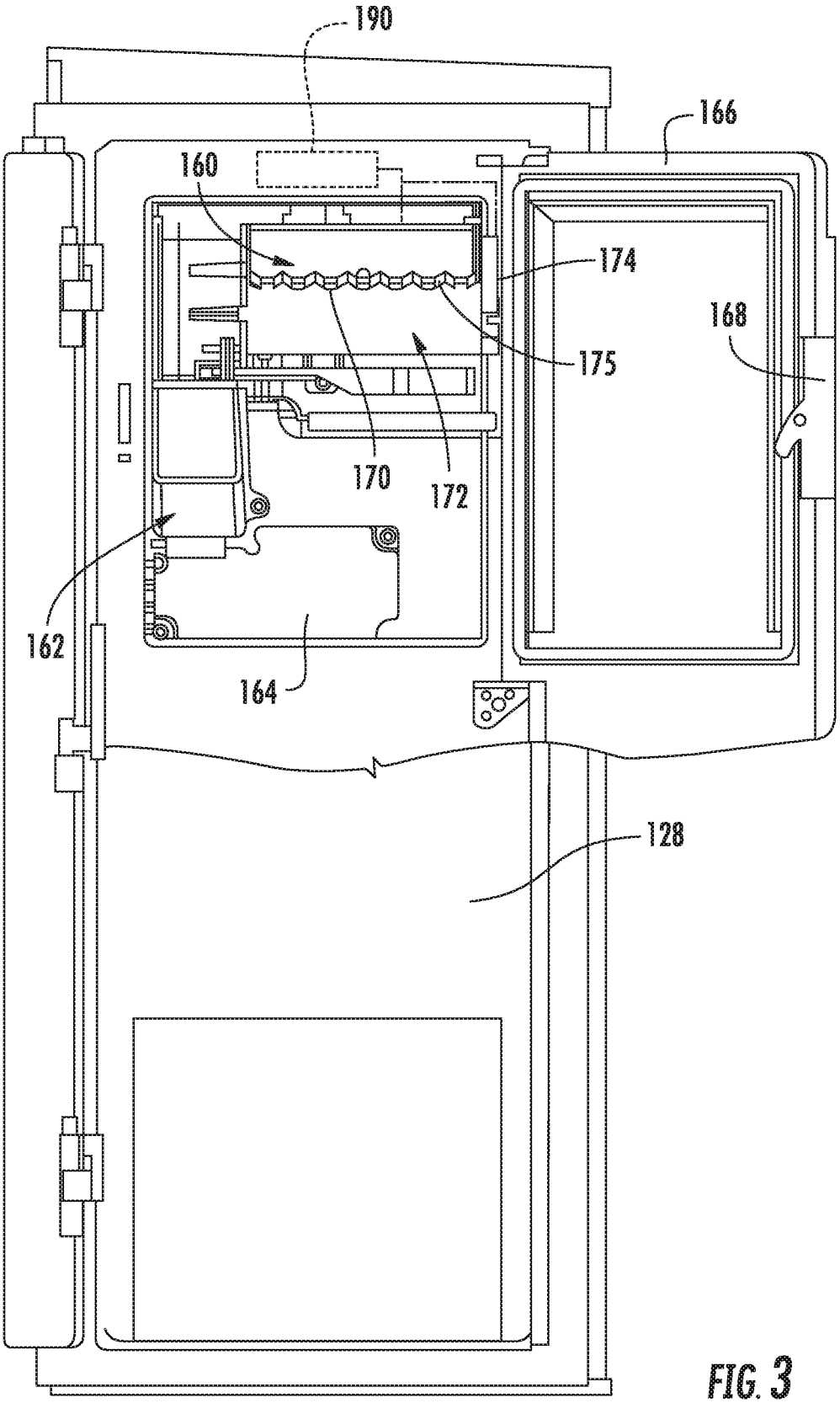
FIG. 3 provides a perspective view of the door of the exemplary refrigerator appliance of FIG. 2, with an access door of the refrigerator door shown in an open position.

FIG. 3 provides a perspective view of refrigerator door 128 with access door 166 shown in an open position. As may be seen in FIG. 3, ice making assembly 160 is positioned or disposed within freezer sub-compartment 162. In some embodiments, ice making assembly 160 includes a mold body or casing 170 for the receipt of water for freezing. In particular, mold body 170 may receive liquid water and such liquid can freeze therein and form ice cubes. Optionally, an ice ejector 172 may be provided to direct ice cubes to dispensing assembly 140. As shown, ejector 172 includes an ejector motor 174 operably attached to one or more ejector arms 175. When activated, ejector motor 174 motivates (e.g., rotates) ejector arm 175 within ice making assembly 160 to remove ice cubes once formed within mold body 170. Ice bucket or ice storage bin 164 is positioned below ejector 172 and receives the ice from ice mold 172. In certain embodiments, controller 190 (FIG. 1) operates various components of ice making assembly 160 to execute selected system cycles and features. For example, controller 190 is operably coupled to motor 174. Under certain conditions, controller 190 can selectively activate and operate the motor 174.

From ice storage bin 164, the ice can enter dispensing assembly 140 and be accessed by a user, as discussed above. In such a manner, ice making assembly 160 can produce or generate ice. It is understood that additional or alternative embodiments may include other features for generating certain types of ice, such as soft or nugget ice.

Figure 4:
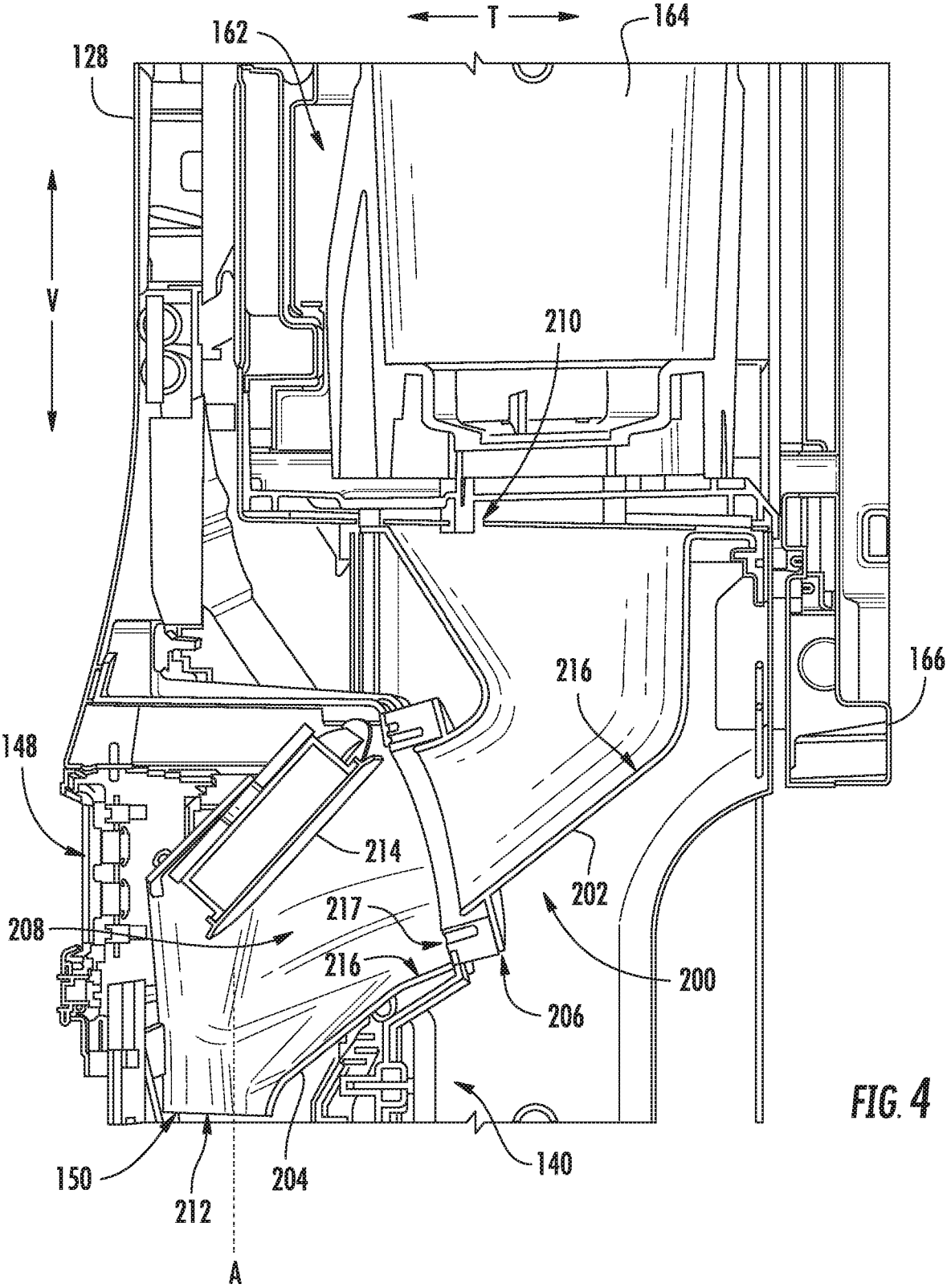
FIG. 4 provides a cross-sectional side view of a dispenser assembly of the exemplary refrigerator appliance of FIG. 1.
Figure 5:
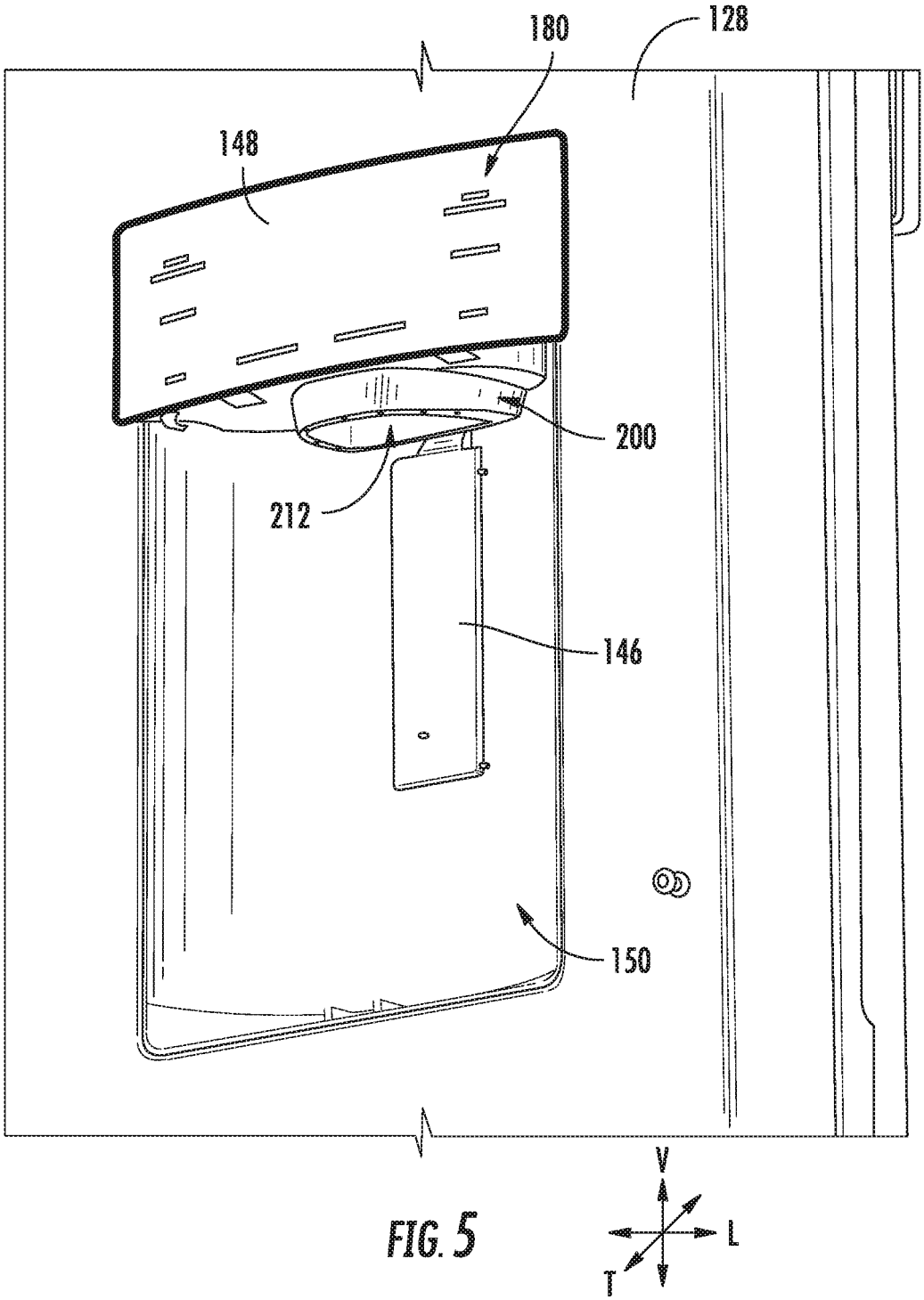
FIG. 5 provides a lower perspective view of a dispenser assembly of the exemplary refrigerator appliance of FIG. 1.

FIG. 4 provides a cross-sectional side view of dispensing assembly 140 of refrigerator appliance 100. FIG. 5 provides a lower perspective view of dispensing assembly 140. As shown, dispensing assembly 140 includes a dispenser conduit 200 positioned at least partially within one of refrigerator doors 128. For instance, dispenser conduit 200 may generally correspond to discharging outlet 144 (FIG. 2), and may serve to guide ice into dispenser recess 150. In some embodiments, dispenser conduit 200 includes a top piece or portion 202 and a bottom piece or portion 204 that are connected or joined together at joint 206. It should be understood that dispenser conduit 200 shown in FIG. 4 is provided by way of example only and that, in alternative exemplary embodiments, dispenser conduit 200 may be formed as a single piece or as more than two pieces (e.g., three, four, or more pieces).

Dispenser conduit 200 defines an ice passage 208. Ice passage 208 of dispenser conduit 200 is configured for directing ice from ice making assembly 160 to dispenser recess 150. In particular, ice passage 208 of dispenser conduit 200 (e.g., defined by an inner surface 216 of one or more chute walls 218) extends between an inlet 210 and an outlet 212. Inlet 210 of ice passage 208 is positioned at or adjacent ice making assembly 160 (FIG. 3) (e.g., below ice storage bin 164), and outlet 212 of ice passage 208 is positioned at or adjacent a top portion of dispenser recess 150, e.g., and forms or corresponds to discharging outlet 144. An axial direction A may be defined by a portion of dispenser conduit 200 (e.g., bottom portion 204). Optionally, axial direction A may be defined parallel to vertical direction V.

As shown, inlet 210 of ice passage 208 may be positioned above outlet 212 of ice passage 208 along the vertical direction V. In some such embodiments, gravity urges ice (e.g., ice cubes or nuggets) from ice storage bin 164 into and through ice passage 208 of dispenser conduit 200 to outlet 212 of ice passage 208. Inlet 210 of ice passage 208 may also be offset from outlet 212 of ice passage 208 along one or more directions that are perpendicular to the vertical direction V (e.g., the transverse direction T or lateral direction L). In some such embodiments, inlet 210 of ice passage 208 is unaligned with outlet 212 of ice passage 208 along the vertical direction V, as shown in FIG. 4. Inlet 210 of ice passage 208 may also have a larger cross-sectional area (e.g., in a plane that is perpendicular to the vertical direction V) than outlet 212 of ice passage 208. Thus, dispenser conduit 200 may funnel ice through ice passage 208 of dispenser conduit 200 from inlet 210 of ice passage 208 to outlet 212 of ice passage 208.

In some embodiments, a duct door 214 is positioned within dispenser conduit 200. For instance, duct door 214 may be at or adjacent the joint 206 between top portion 202 and bottom portion 204 of dispenser conduit 200. Duct door 214 is selectively adjustable (e.g., rotatable) between an open position (shown in FIG. 4) and a closed position. In the closed position, duct door 214 is positioned between dispenser recess 150 and freezer sub-compartment 162. Thus, duct door 214 may block or hinder air flow between dispenser recess 150 and freezer sub-compartment 162 and reduce heat transfer between dispenser recess 150 and freezer sub-compartment 162. Conversely, in the open position, duct door 214 is not positioned between dispenser recess 150 and freezer sub-compartment 162. Thus, nugget ice from ice making assembly 160 may flow through ice passage 208 to outlet 212 of ice passage 208 without impacting duct door 214. Duct door 214 may normally be in the closed position and may shift to the open position when a user operates actuating mechanism 146 (FIG. 1). Dispenser conduit 214 may be sized and shaped, e.g., with a recess 217, for permitting movement or rotation of duct door 214 between the open and closed positions within dispenser conduit 214.

Along with ice passage 208, one or more fluid inlets and corresponding fluid outlets are defined through a portion of dispenser conduit 200, as will be described in detail below.

Figure 6:
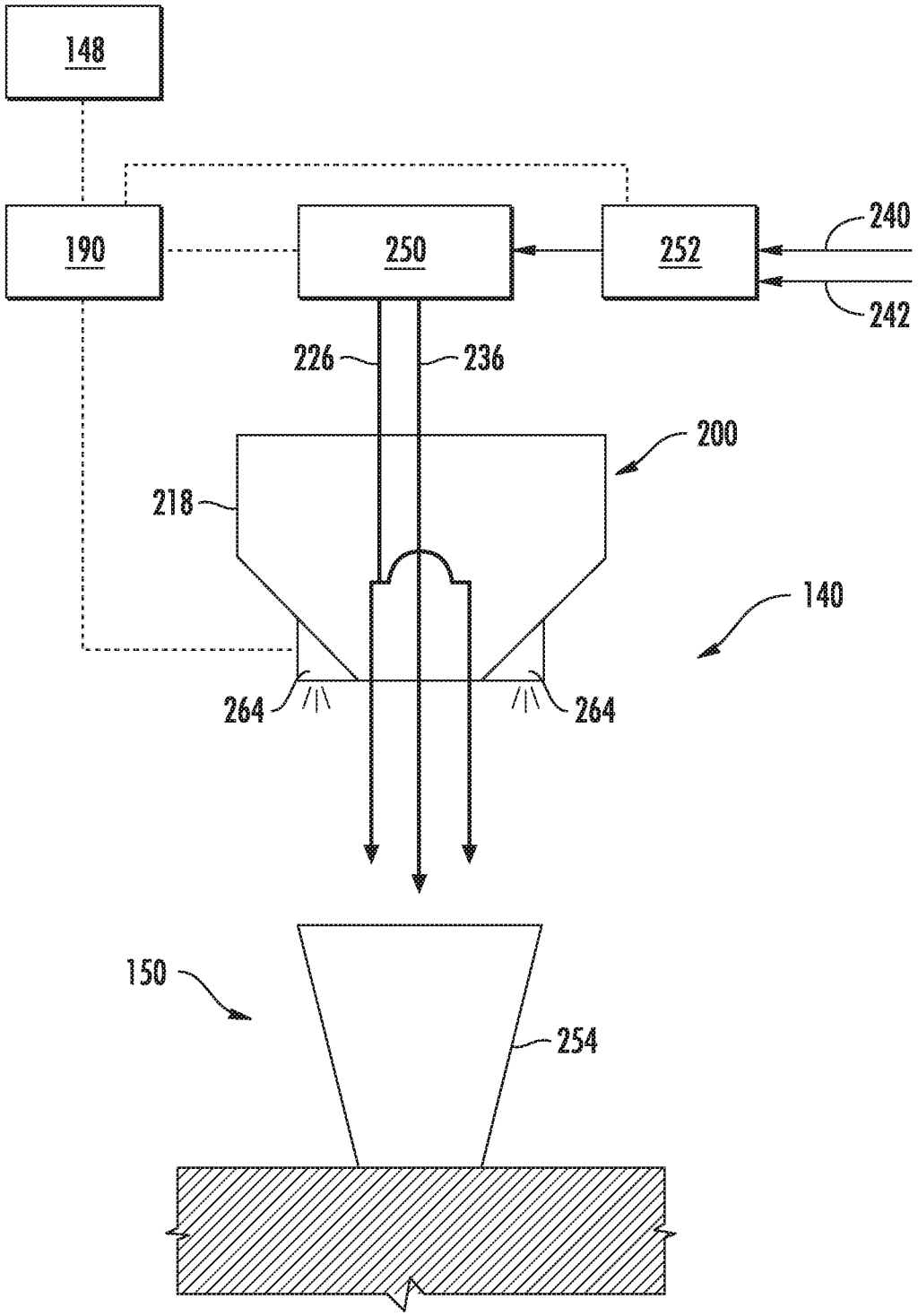
FIG. 6 provides a schematic view of a dispenser assembly according to exemplary embodiments of the present disclosure.
Figure 7:
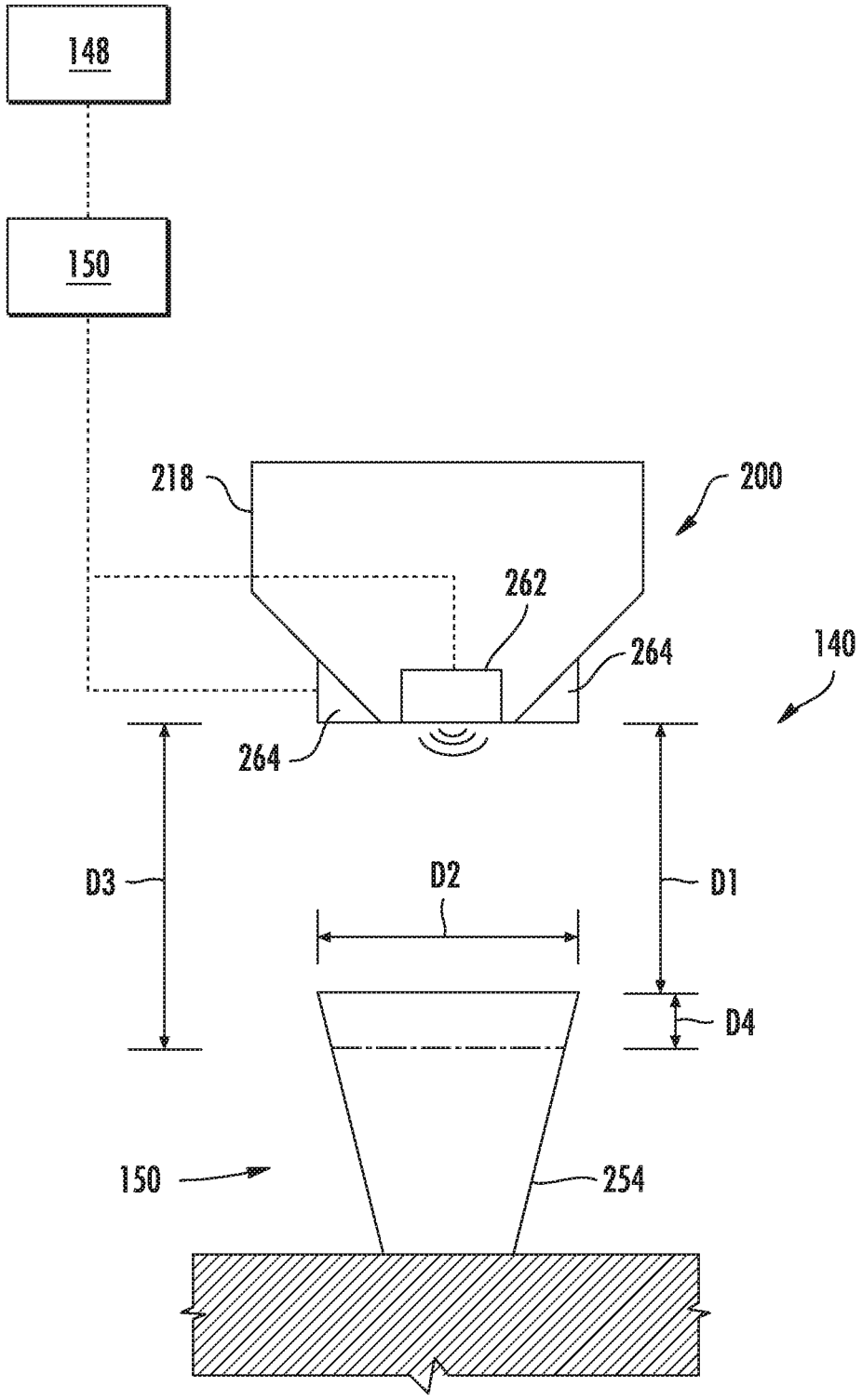
FIG. 7 provides another schematic view of a dispenser assembly according to exemplary embodiments of the present disclosure.

Turning now to FIGS. 6 and 7, multiple schematic views are provided illustrating various elements of exemplary embodiments of dispensing assembly 140. In some embodiments, a discrete first fluid path 226 and second flow path 236 may be defined in fluid parallel relative to each other.

As illustrated, dispensing fluid (e.g., water) may be selectively or alternately directed from dispenser conduit 200 through first fluid path 226 or second flow path 236 from one or more fluid sources (e.g., a hot water source 240 and a cold water source 242). Thus, characteristics of the fluid flow to a container 254 (e.g., cup, bottle, etc.) within dispenser recess 150 may be varied based on one or more conditions. In some such embodiments, the flow rate of fluid dispensed from first fluid path 226 (e.g., volumetric flow rate of water exiting dispenser conduit 200 from first fluid path 226 through one or more first fluid outlets 222) may be greater than the flow rate of fluid dispensed from second flow path 236 (e.g., volumetric flow rate of water exiting dispenser conduit 200 from second flow path 236 through one or more second fluid outlets 232). In other words, first fluid path 226 may dispense fluid at a first rate while second flow path 236 dispenses fluid at a second flow rate that is less than the first flow rate. Advantageously, dispensing assembly 140 may thus selectively change the flow rate of fluid dispensed therefrom.

Figure 8:
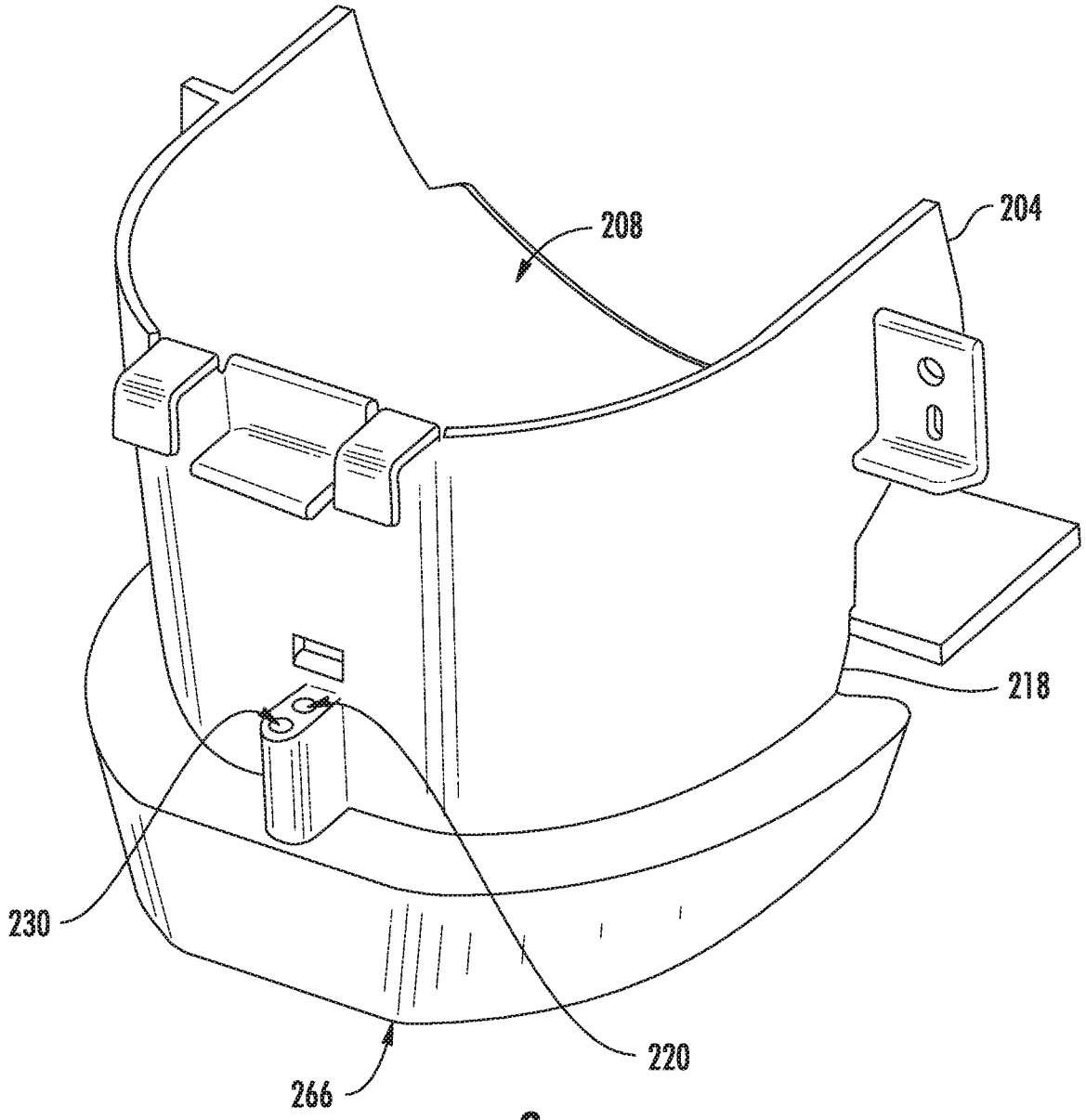
FIG. 8 provides a perspective view of a conduit portion of a dispenser assembly according to exemplary embodiments of the present disclosure.
Figure 9:
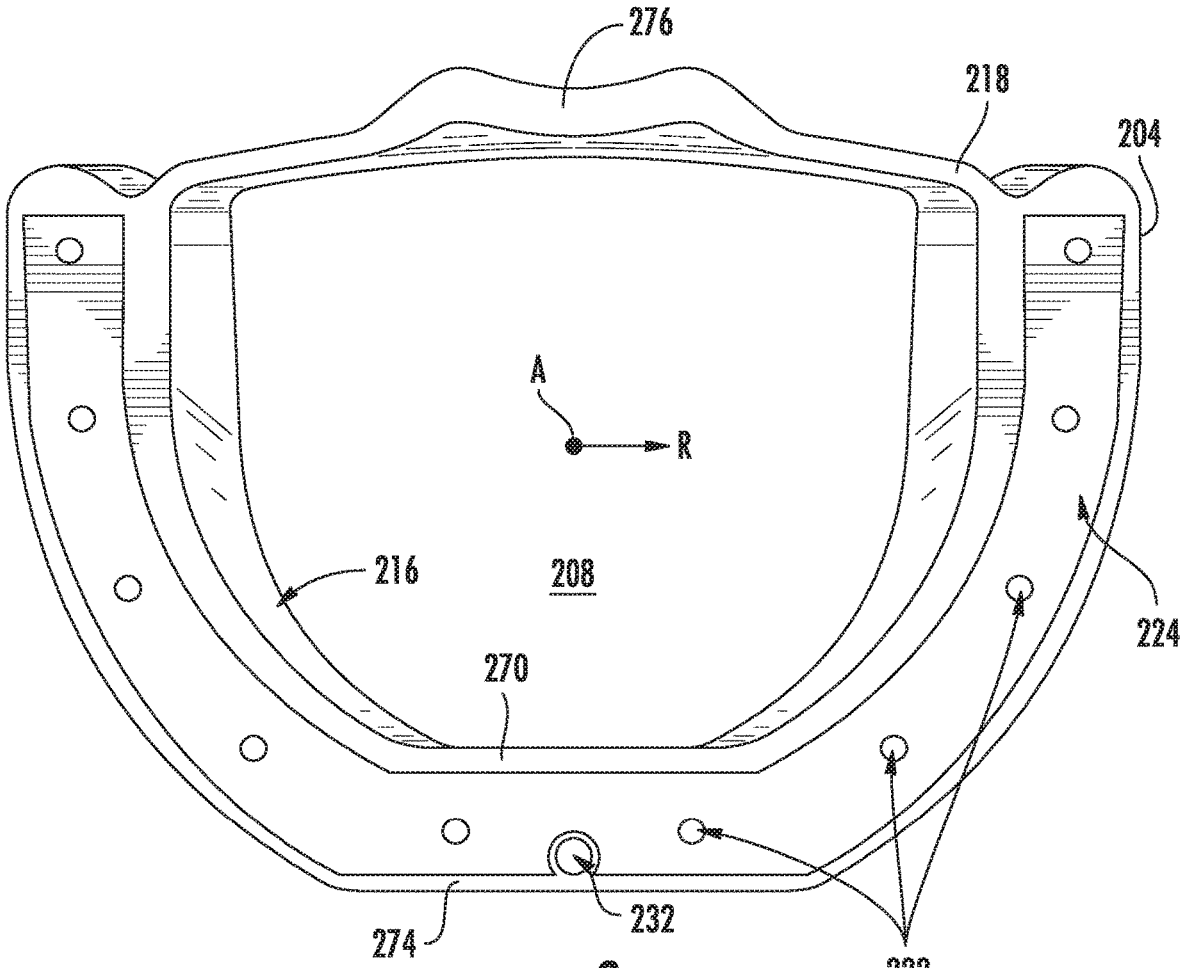
FIG. 9 provides a cross-sectional top view of the exemplary conduit portion of FIG. 8.
Figure 10:
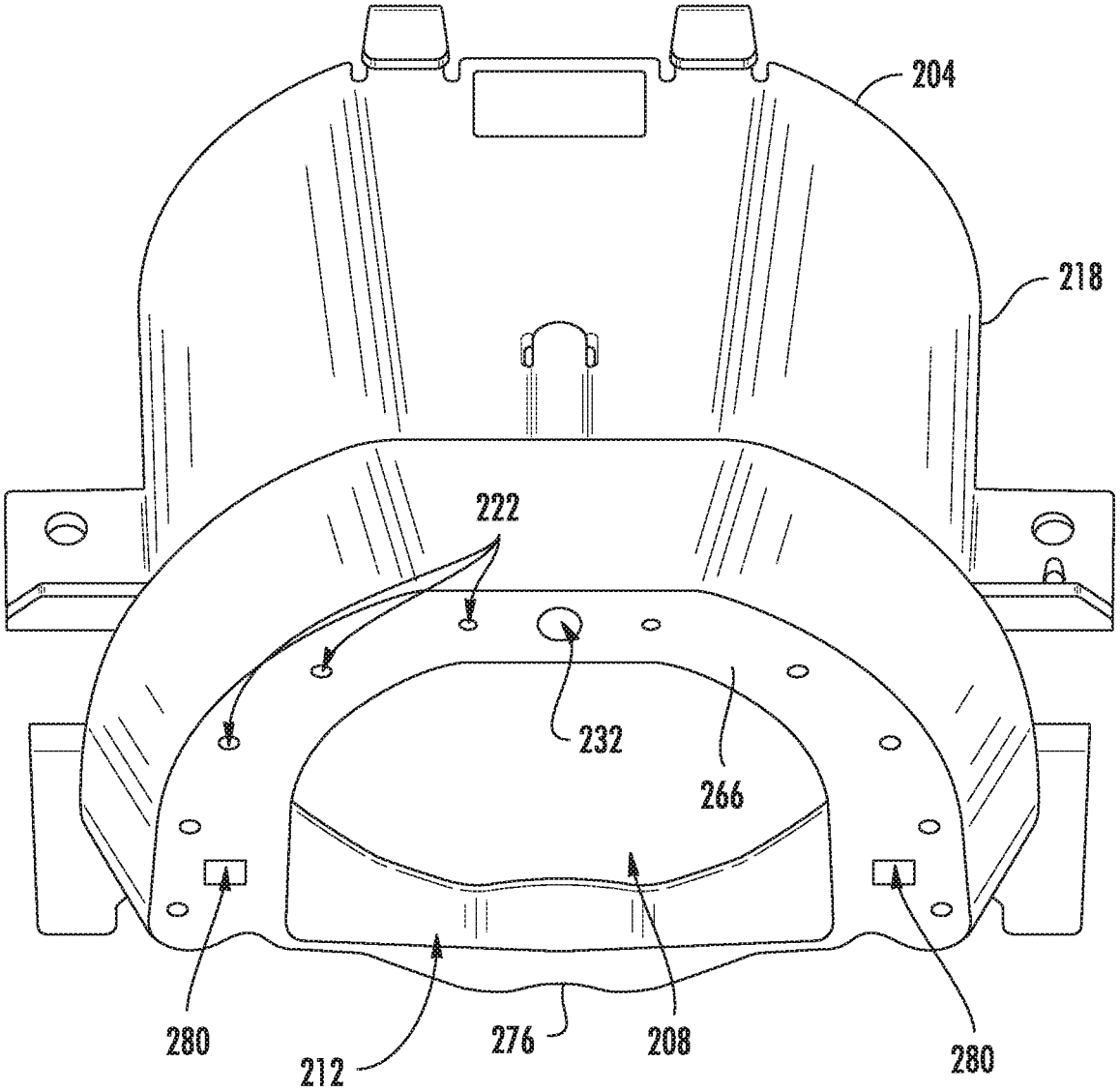
FIG. 10 provides a lower perspective view of the exemplary conduit portion of FIG. 8.
Figure 11:
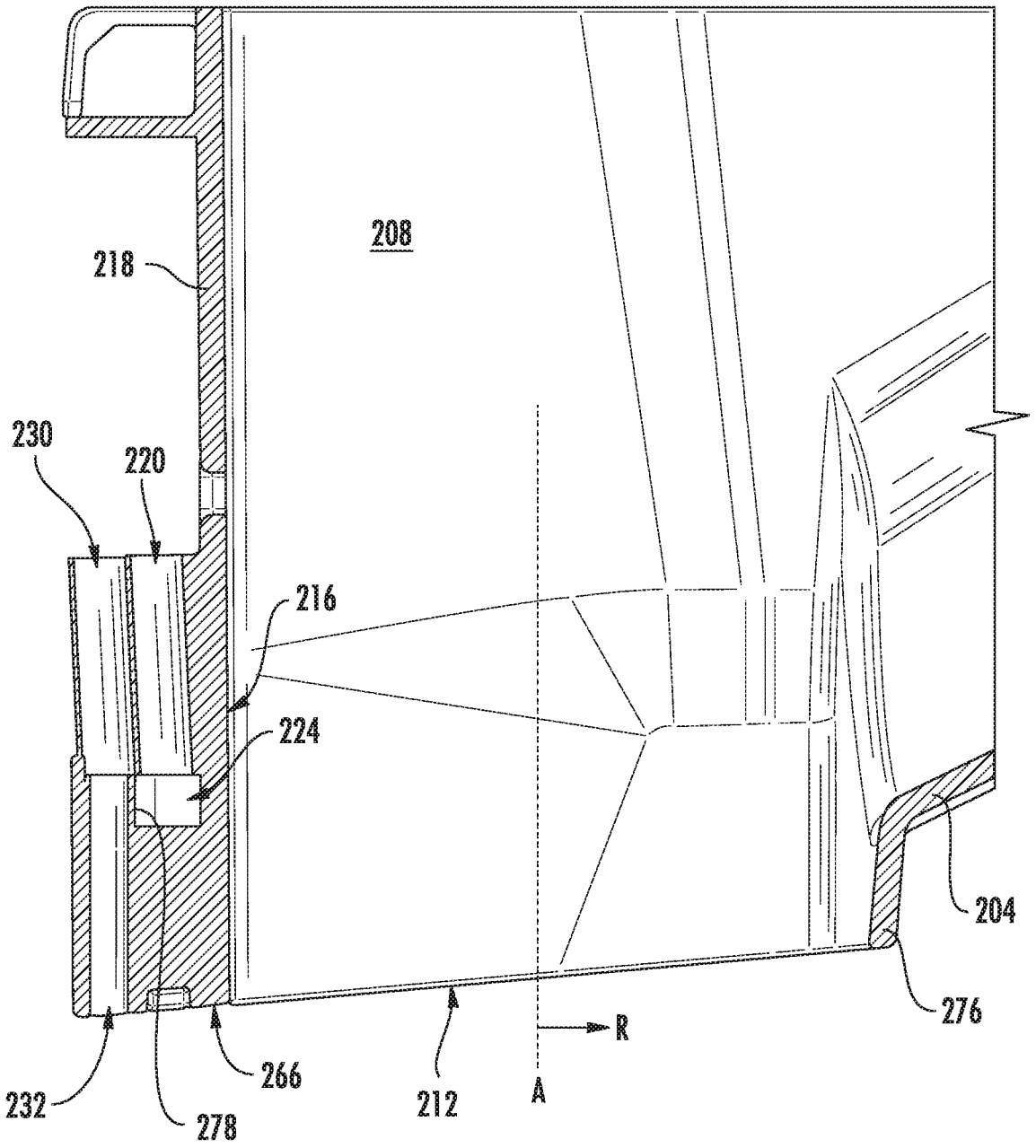
FIG. 11 provides a cross-sectional side view of the exemplary conduit portion of FIG. 8.
Figure 12:
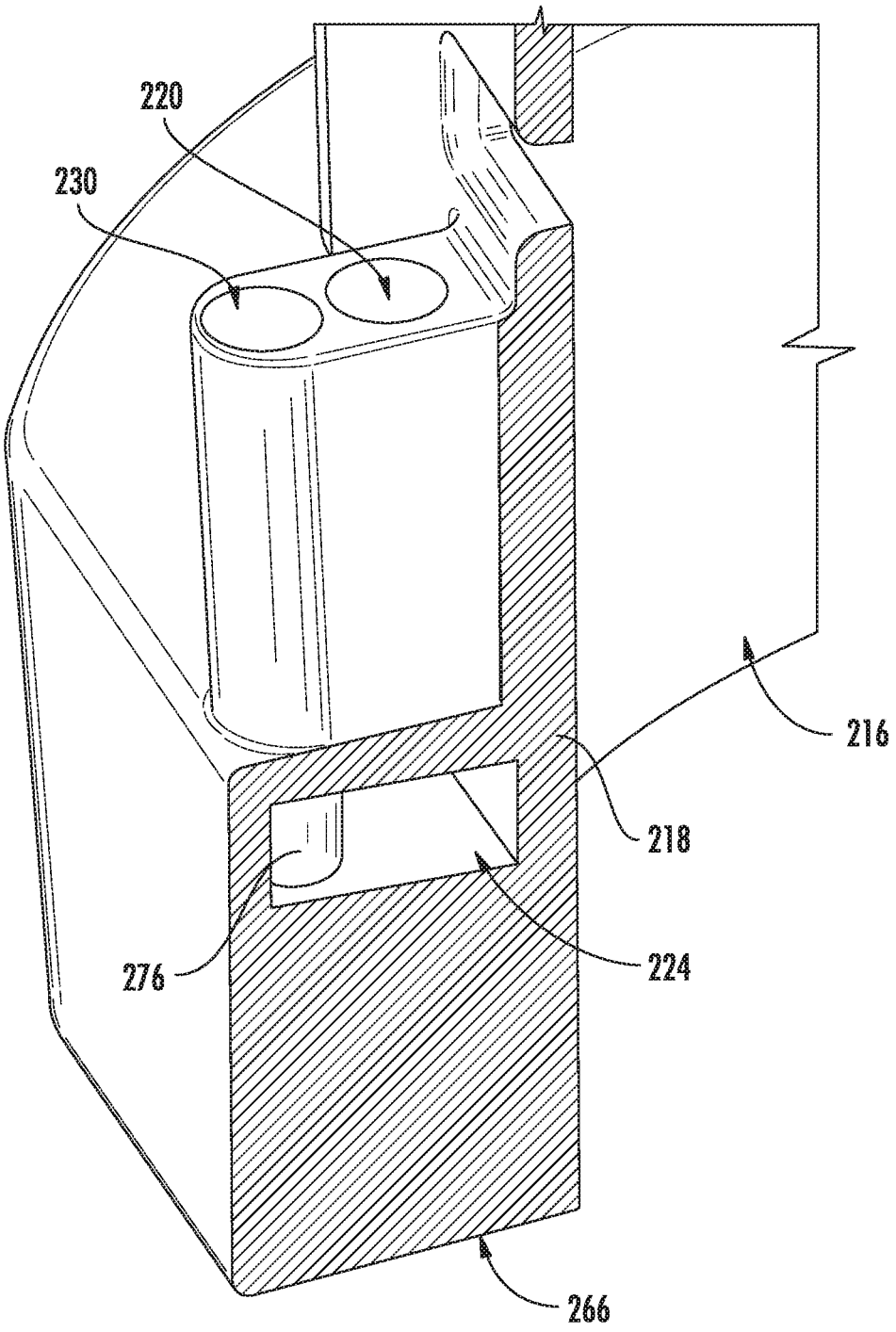
FIG. 12 provides a cross-sectional, side, perspective view of the exemplary conduit portion of FIG. 8.
Figure 13:
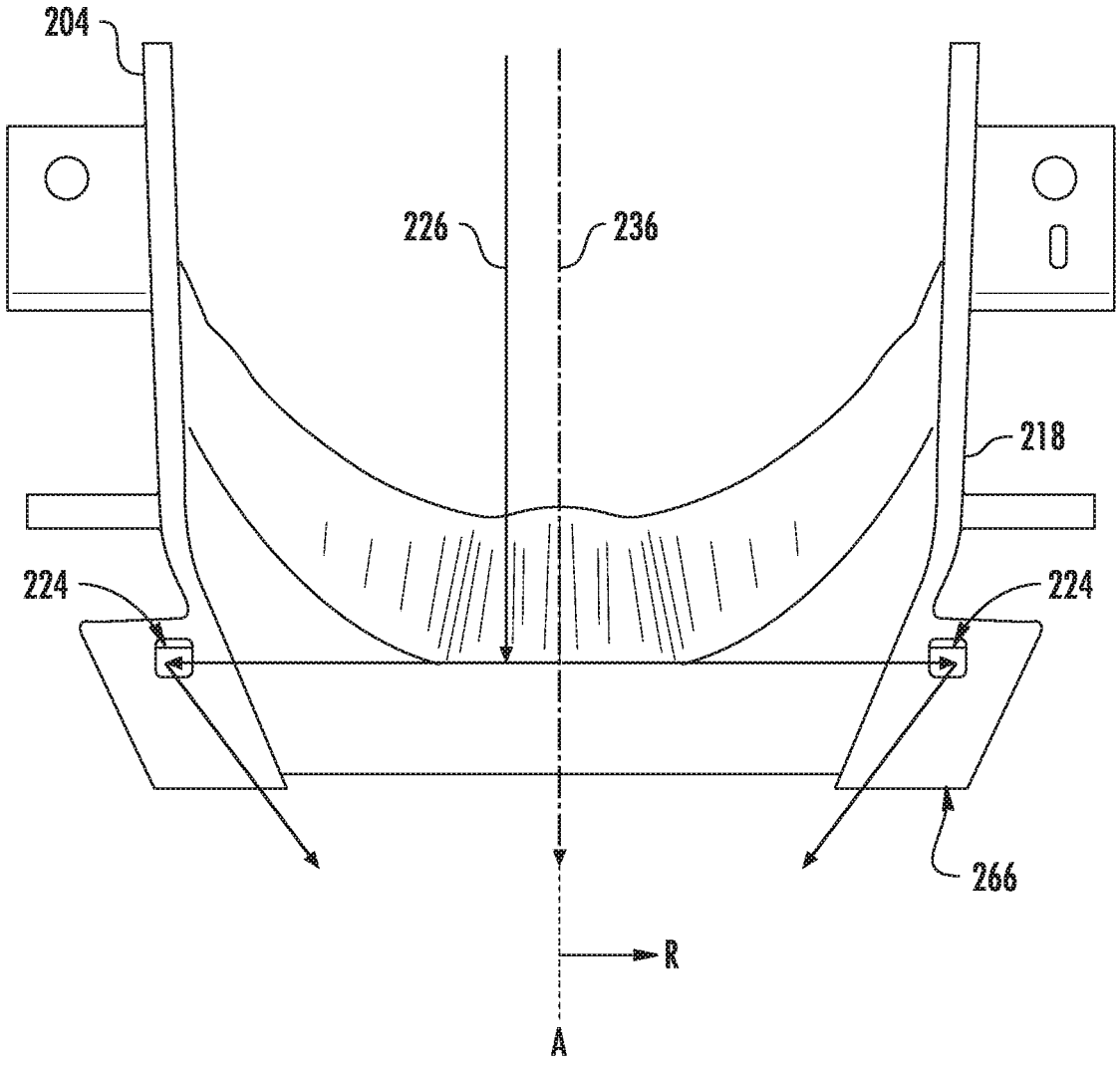
FIG. 13 provides a cross-sectional front view of the exemplary conduit portion of FIG. 8, illustrating multiple fluid flow paths through conduit portion.

In some embodiments, a multi-path valve 250 is provided downstream from the fluid source(s) (e.g., hot water source 240 and cold water source 242) and upstream from the fluid outlets 222, 232 (e.g., FIG. 10) of dispenser conduit 200. As shown in the exemplary embodiments of FIG. 6, multi-path valve 250 is mounted within a refrigerator door 128 (e.g., FIG. 5) and upstream from the first and second fluid inlets 220, 230 (e.g., FIG. 8). Optionally, multi-path valve 250 may be provided as an electronic valve (e.g., having an electrically-controlled solenoid) to change or alternate the position (e.g., flow path) within multi-path valve 250.

During use, multi-path valve 250 may be moved or operated (e.g., manually or as directed by controller 190) to selectively or alternately direct the fluid flow through the first and second fluid paths 226, 236. In other words, multi-path valve 250 is positioned in upstream fluid communication with first fluid outlet(s) 222 and second fluid outlet(s) 232 e.g., FIG. 8) to control which outlet(s) fluid (e.g., water) flows from. Multi-path valve 250 may be moved between a first position and a second position. In the first position, water is directed from water source(s) 240, 242 to the first fluid path 226, while restricting water flow to the second fluid path 236. In the second position, water is directed from water source(s) 240, 242 to the second fluid path 236, while restricting water flow to the first fluid path 226.

In optional embodiments, a pressure-regulating valve 252 is provided upstream from dispenser conduit 200 or multi-path valve 250 to selectively control or direct the pressure of fluid to the fluid paths 226, 236. For instance, pressure-regulating valve 252 may be operably coupled to controller 190, which is configured to selectively limit fluid flow from pressure-regulating valve 252 according to one or more predetermined pressure values. Additionally or alternatively, controller 190 may be configured to provide a constant predetermined pressure for fluid flow from pressure-regulating valve 252.

In certain embodiments, controller 190 is configured to control or direct movement of multi-path valve 250 between a first and second position according a user input (e.g., received at user interface 148) corresponding to a desired fluid paths 226, 236 or container size (e.g., according to a user input or an automatic determination of an appropriate fluid flow path based on the size of a container 254 within dispenser recess 150).

In additional or alternative embodiments, controller 190 is configured to control or direct movement of multi-path valve 250 between a first and second position automatically (e.g., without direct input or signals indicative of a desired flow path from a user). As illustrated in FIG. 7, a proximity sensor 262 may be operably coupled to controller 190 and directed toward dispenser recess 150. For instance, proximity sensor 262 may be mounted on dispenser conduit 200 such that a container 254 within recess 150 is positioned below proximity sensor 262. However, it is understood that any other suitable location for proximity sensor 262 (e.g., outside or spaced apart from dispenser conduit 200) to detect a container 254 below conduit 200 may further be provided.

Generally, proximity sensor 262 may be operable to detect the presence of a presented object (e.g., container 254). Optionally, proximity sensor 262 may be operable to measure the height of the presented container 254 (e.g., the distance between proximity sensor 262 and presented container 254). In exemplary embodiments, proximity sensor 262 can be any suitable device for detecting or measuring distance to an object. For example, proximity sensor 262 may be an ultrasonic sensor, an infrared sensor, or a laser range sensor. Controller 190 can receive a signal, such as a voltage or a current, from proximity sensor 262 that corresponds to the detected presence of or distance to a presented container 254.

In some embodiments, controller 190 is configured to control or direct fluid flow from dispenser conduit 200 based on container size (e.g., as determined from one or more signals received from proximity sensor 262). For instance, controller 190 can determine a container distance D1 for the (e.g., vertical length) between proximity sensor 262 and an uppermost portion of container 254. Controller 190 can further determine a horizontal width D2 (e.g., diameter in the lateral direction L—FIG. 5) for the uppermost portion or lip of container 254. A water level D3 may further be determined for a vertical length between proximity sensor 262 and an uppermost portion of fluid within container 254. In some such embodiments, controller 190 is configured to automatically move multi-path valve 250 to the first position only if the horizontal width D2 is greater than a predetermined threshold width. If the horizontal width D2 is less than or equal to the predetermined threshold, controller 190 may limit fluid flow from dispenser conduit 200 to the second fluid flow path 236 (FIG. 6) (e.g., by maintaining multi-path valve 250 in the second position during liquid dispensing operations).

Additionally or alternatively, controller 190 can be configured to fill a container 254 to a preset fluid level D3 (e.g., upon receiving a dispensing signal from user interface 148 or actuating mechanism 146—FIG. 5). As fluid (e.g., water) is dispensed from dispenser conduit 200, controller 190 may receive multiple signals from proximity sensor 262 (e.g., initiated at a predetermined interval) to track the height of fluid as it rises within container 254. Once the fluid level D3 reaches a set height D4 (e.g., measured as container distance D1 plus a predetermined height value), controller 190 may halt the flow of fluid to container 254 (e.g., by closing or halting flow through multi-path valve 250 or pressure-regulator valve).

Optionally, controller 190 can be configured to further control any other suitable characteristics of the fluid flow from dispenser conduit 200 based on one or more signals received from proximity sensor 262. For instance, controller 190 may control the temperature of dispensed fluid based on the size or type of container 254 positioned within dispenser recess 150. In some such embodiments, controller 190 is configured to selectively control the ratio of fluid from multiple sources (e.g., the ratio of water from a hot water source 240 and a cold water source 242) that is dispensed from multi-path valve 250. Optionally, one or more mixing valves may be provided upstream from dispenser conduit 200 (e.g., and downstream from water sources 240, 242) and operably coupled to controller 190 to selectively control, for instance, the ratio of hot water to cold water dispensed through the flow paths 226, 236.

In further additional or alternative embodiments, one or more light sources 264 are operably coupled to controller 190 and directed toward dispenser recess 150, as shown in FIGS. 6 and 7. For instance, light source(s) 264 may be mounted on dispenser conduit 200 such that a container 254 within recess 150 is positioned below light source(s) 264. In some such embodiments, light source(s) 264 are directed toward the fluid flow path(s) 226, 236 exiting from dispenser conduit 200.

Generally, light source 264 may be any suitable device or bulb for projecting visible light to dispenser recess 150 (e.g., illuminate a fluid flow exiting dispenser conduit 200 through the fluid outlets 222, 232). For instance, light source 264 may include one or more light emitting diodes (LEDs). Optionally, the LEDs or light source 264 may be configured to illuminate the fluid flow from dispenser conduit 200 as one or more colors. In such embodiments, it may be desirable to select the color in which the fluid flow is to be illuminated based on temperature of the liquid(s) being dispensed. Controller 190 may be configured to direct a color of the light source 264. In particular, the directed color may be based on the fluid flow temperature (e.g., whether the fluid flow from the fluid source corresponds to a hot water source 240 or a cold water source 242). As an example, in exemplary embodiments, controller 190 is configured to direct light source 264 to illuminate as a blue color to indicate to indicate the cooler temperature of the liquid being dispensed flows from the cold water source 242. As an additional or alternative example, in exemplary embodiments, controller 190 is configured to direct light source 264 to illuminate as a red color to indicate to indicate the warmer temperature of the liquid being dispensed flows from the hot water source 240.

Additionally, it should be appreciated that, in certain embodiments, the light source(s) 264 described herein may be configured to illuminate the dispenser recess 150 continuously (e.g., as directed by controller 190). Alternatively, the light source(s) 264 may only be configured to illuminate during certain times or based on certain trigger events (e.g., as directed by controller 190). As an example, the light source 264 may be configured to direct light towards the dispenser recess 150 only as liquid flows from dispenser conduit 200.

Optionally, controller 190 can be configured to further control any other suitable characteristics of the illumination from light sources 264 based on one or more signals received from proximity sensor 262. For instance, controller 190 may be configured to direct light source 264 to illuminate in multiple discrete colors based on the size or type of container 254 positioned within dispenser recess 150. In some such embodiments, controller is configured to direct light source 264 to illuminate as a first color when one size or type of container 254 is detected through proximity sensor 262, and illuminate a second discrete or unique color when another size or type of container 254 is detected through proximity sensor 262.

Advantageously, exemplary embodiments may provide easily-viewed information relating to the flow of liquid at the location of the flow.

Turning now to FIGS. 8 through 13, various views are provided of a conduit portion (e.g., bottom portion 204) for a dispenser conduit 200 according to exemplary embodiments. The exemplary embodiments of FIGS. 8 through 13 may be provided as, as part of, or in alternative to one or more of the exemplary embodiments of dispenser conduit 200, as described above. In turn, it is understood that the exemplary embodiments of FIGS. 8 through 13 may include all or some of the above-described features, except as otherwise indicated.

As illustrated, dispenser conduit 200 includes a chute wall 218 that defines at least a portion of ice passage 208 along an axial direction A (e.g., parallel to the vertical direction V when assembled). For instance, outlet 212 may be defined along the axial direction A. Ice dispensed from dispenser conduit 200 may thus generally exit along the axial direction A. A radial direction R may extend outward (e.g., perpendicular to) the axial direction A.

In some embodiments, a separate first fluid inlet 220 and second fluid inlet 230 are defined through a portion of a chute wall 218. Both fluid inlets 220, 230 may be defined in fluid communication with one or more common water sources (e.g., 240, 240—FIG. 6) and one or more respective downstream fluid outlets 222, 232. The first fluid path 226 (FIG. 6) may be defined (at least in part) between a first fluid inlet 220 and first fluid outlet(s) 222 downstream therefrom. The second flow path 236 (FIG. 6) may be defined (at least in part) between the second fluid inlet 230 and the second fluid outlet(s) 232 downstream therefrom. When assembled, each of the fluid inlets 220, 230 may be defined in fluid parallel to each other.

In certain embodiments, a first fluid inlet 220 is defined on chute wall 218 in fluid isolation from ice passage 208—e.g., downstream from fluid source(s) 240, 242 (FIG. 6), as discussed above. First fluid inlet 220 may be positioned radially outward from the ice passage 208 or axial direction A. Moreover, first fluid inlet 220 may be positioned above outlet 212 or first fluid outlets 222. Additionally or alternatively, first fluid inlet 220 may be positioned at a front portion of chute wall 218.

A first manifold channel 224 is defined downstream from first fluid inlet 220 (i.e., in downstream fluid communication with first fluid inlet 220). In particular, first manifold channel 224 may be defined to extend within chute wall 218 between an internal radial partition 270 and an external radial partition 274. Internal radial partition 270 may be positioned between ice passage 208 and first manifold channel 224 along the radial direction R, while external radial partition 274 is positioned between first manifold channel 224 and the ambient environment (e.g., in front of dispenser conduit 200) along the radial direction R. As shown, first manifold channel 224 extends (at least partially) about ice passage 208. In the exemplary embodiments of FIGS. 8 through 13, first manifold channel 224 is formed as a U-shaped fluid passage disposed, for example, perpendicular to the axial direction A. Optionally, a mid-point or vertex of the shaped "U" may be positioned in front of ice passage 208. In some such embodiments, a solid rear wall segment 276 of chute wall 218 extends between the end points of the shaped "U" and encloses ice passage 208 (e.g., at a rearmost portion thereof). First fluid inlet 220 may generally extend to first manifold parallel to the axial direction A and intersect first manifold channel 224. In the illustrated embodiments of FIGS. 8 through 13, first fluid inlet 220 intersects first manifold channel 224 at a mid-point or vertex of the shaped "U."

In the exemplary embodiments of FIGS. 8 through 13, a plurality of discrete first fluid outlets 222 are defined through chute wall 218. Each first fluid outlet 222 may be downstream from first manifold channel 224 (i.e., in downstream fluid communication with first manifold channel 224 and first fluid inlet 220). Moreover, although the first fluid outlets 222 need not be in perfect geometric parallel to the axial direction A, each first fluid outlet 222 may generally extend along the axial direction A from first manifold channel 224 to a bottom lip 266 of chute wall 218. Optionally, the first fluid outlets 222 may be directed radially inward (e.g., at a non-parallel angle) toward axial direction A such that liquid flowing from the first fluid outlets 222 can converge at a location along the axial direction A that is below chute wall 218. In certain embodiments, the discrete first fluid outlets 222 are circumferentially spaced apart along first manifold channel 224. In other words, each discrete first fluid outlet 222 intersects first manifold channel 224 at a separate circumferential location of first manifold channel 224. Moreover, each first fluid outlet 222 may be defined in fluid parallel to the other first fluid outlets 222. During use, a liquid (e.g., water) may thus be selectively flowed through first fluid inlet 220 to first manifold channel 224. Within first manifold channel 224, some of the liquid may be flowed circumferentially and, thus, to each of the first fluid outlets 222. From the first fluid outlets 222, the liquid may be dispensed to the dispenser recess 150.

In some embodiments, a second fluid inlet 230 is defined on chute wall 218 in fluid isolation from ice passage 208—e.g., downstream from fluid source(s) 240, 242 (FIG. 6), as discussed above. Second fluid outlet 232 may further be defined in fluid parallel to first fluid inlet 220. Second fluid inlet 230 may be positioned radially outward from the ice passage 208 or axial direction A (e.g., adjacent to or spaced apart from first fluid inlet 220). Moreover, second fluid inlet 230 may be positioned above outlet 212 or a second fluid outlet 232. Additionally or alternatively, second fluid inlet 230 may be positioned at a front portion of chute wall 218.

In the exemplary embodiments of FIGS. 8 through 13, a single second fluid outlet 232 is defined through chute wall 218. Second fluid outlet 232 is defined downstream from second fluid inlet 230 (i.e., in downstream fluid communication with second fluid inlet 230). Moreover, second fluid outlet 232 may be in fluid isolation or fluid parallel to the first fluid outlets 222 and first manifold channel 224. Optionally, a secondary wall 278 may extend from second fluid inlet 230 to second fluid outlet 232 and through first manifold channel 224 (e.g., at a front portion of chute wall 218), such that liquids from second fluid inlet 230 do not pass to first manifold channel 224. Although second fluid outlet 230 need not be in perfect geometric parallel to the axial direction A, second fluid outlet 232 may generally extend along the axial direction A at a bottom lip 266 of chute wall 218. In certain embodiments, the second fluid outlet 232 is defined through chute wall 218 at a front portion thereof. During use, a liquid (e.g., water) may thus be selectively flowed through second fluid inlet 230 to second fluid outlet 232, from which the liquid may be dispensed to the dispenser recess 150.

In exemplary embodiments, one or more fluidly-isolated compartments 280 are defined within chute wall 218 to receive a light source 264 or proximity sensor 262 (FIG. 7). For instance, the compartments 280 may be defined at a bottom lip 266 of chute wall 218 separate from fluid outlets 222, 232 and ice passage 208 (e.g., such that liquids or ice are not directed therethrough). One or more proximity sensors 262 or light sources 264 may be mounted within chute wall 218 and received within a fluidly-isolated compartment 280. When mounted, the proximity sensor 262 or light source 264 may be directed toward dispenser recess 150 (FIG. 5). In certain embodiments, a plurality of fluidly-isolated compartments 280 is defined within chute wall 218. As shown, each of the fluidly-isolated compartments 280 is spaced apart (e.g., circumferentially) from each other about the axial direction A or ice passage 208.

As described above, a multi-path valve 250 (FIG. 6) may be positioned in upstream fluid communication with the plurality of discrete first fluid outlets 222 and the second fluid outlet 232 (e.g., within a refrigerator door upstream from the fluid inlets 220, 230). A liquid may be selectively flowed through the first fluid path 226 or the second fluid path 236 (FIG. 6). During use, the multi-path valve 250 may thus alternately direct the fluid flow from the fluid source to the first plurality of discrete fluid outlets 222, 232 and the second fluid outlet 232.

Figure 14:
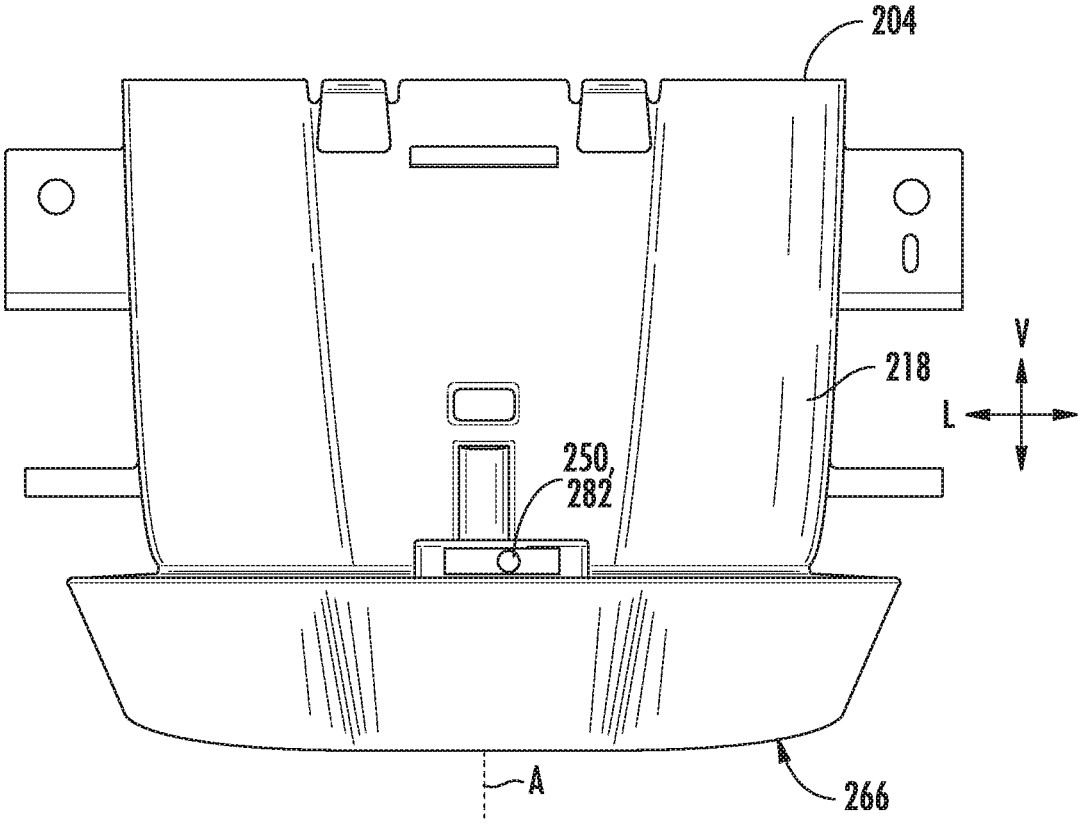
FIG. 14 provides a perspective view of a conduit portion of a dispenser assembly according to exemplary embodiments of the present disclosure.
Figure 15:
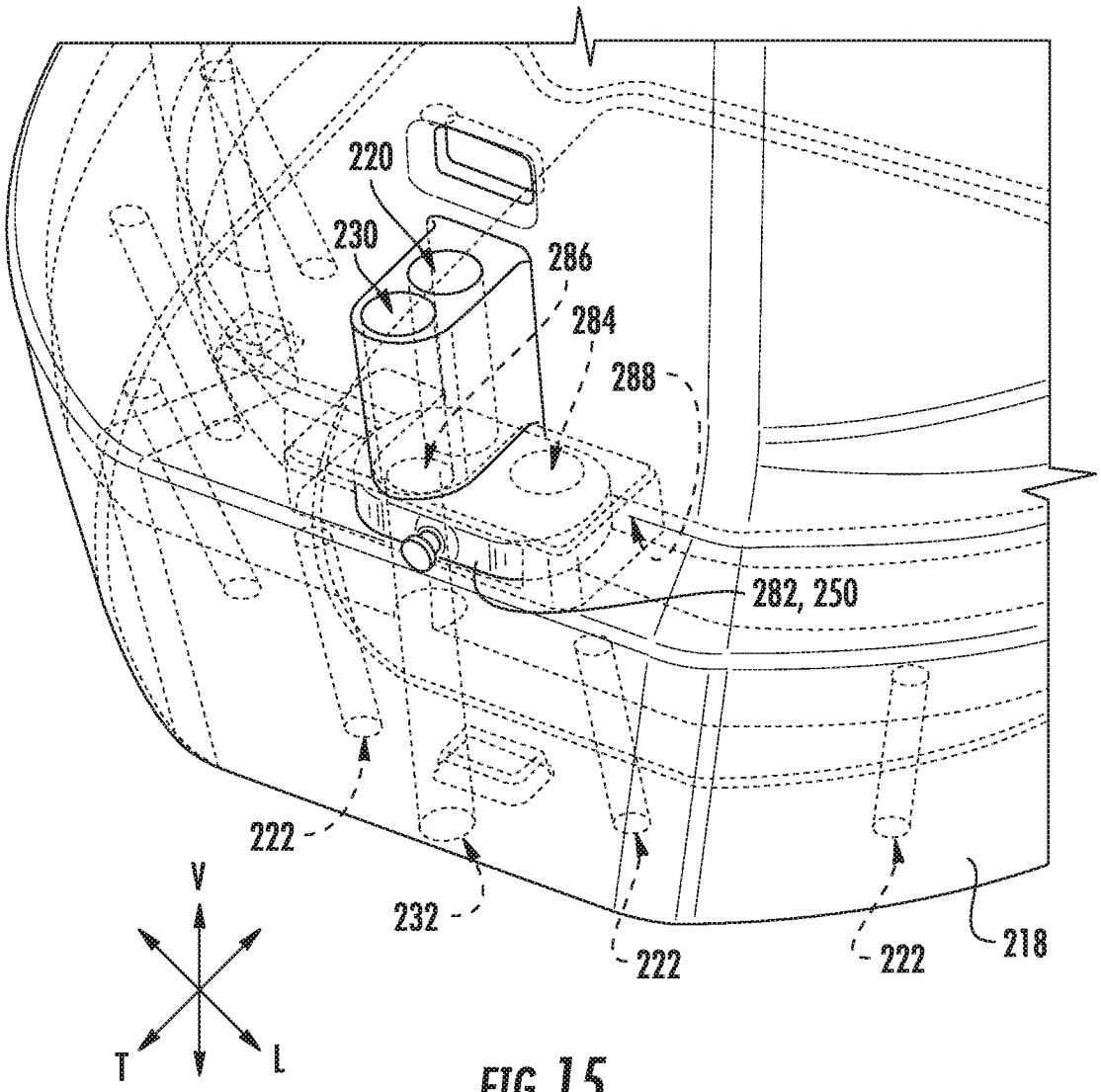
FIG. 15 provides a partially-transparent perspective view of a portion of the exemplary conduit portion of FIG. 14.

Turning now to FIGS. 14 and 15, various views are provided of a conduit portion (e.g., bottom portion 204) for a dispenser conduit 200 according to exemplary embodiments. The exemplary embodiments of FIGS. 14 and 15 may be provided as, as part of, or in alternative to one or more of the exemplary embodiments of dispenser conduit 200, as described above. In turn, it is understood that the exemplary embodiments of FIGS. 14 and 15 may include all or some of the above-described features, except as otherwise indicated.

For instance, although certain above-described embodiments describe multi-path valve 250 generally, the exemplary embodiments of FIGS. 14 and 15 illustrate an exemplary switch valve for multi-path valve 250. Generally, multi-path valve 250 may be moved to alternately direct the fluid flow from the fluid source(s) (FIG. 6) to first fluid outlets 222 and second fluid outlet 232. For instance, multi-path valve 250 may be moved manually by a user or, alternatively, automatically by a mechanically-coupled electronic motor that is operably coupled to controller 190 (FIG. 6).

As shown, multi-path valve 250 may include a slidable plate 282 defining a first-path passage 284 and a second-path passage 286. Each of the first-path passage 284 and second-path passage 286 may be spaced apart from each other (e.g., in the lateral direction L or the transverse direction T). Slidable plate 282 may be mounted within a plate cavity 288 defined in chute wall 218 (e.g., at a front portion thereof). For instance, plate cavity 288 may be defined between the fluid inlets 220, 230 and the fluid outlets 222, 232 (e.g., along the vertical direction V). Moreover, plate cavity 288 may generally be provided within an excess length or width to permit slidable plate 282 to move (e.g., slide along the lateral direction L) within plate cavity 288 between a first position and a second position.

In the first position, first-path passage 284 may be axially-aligned with first fluid inlet 220, thereby permitting liquid from first fluid inlet 220 to first cavity manifold 224 (e.g., FIG. 9) and first fluid outlets 222. Second-path passage 286 may be offset from second fluid inlet 230 (e.g., a solid non-permeable portion of slidable plate 282 may be axially aligned with the second fluid inlet 230), thereby restricting or preventing liquid from second fluid inlet 230. In the second position (e.g., illustrated at FIG. 15), second-path passage 286 may be axially-aligned with second fluid inlet 230, thereby permitting liquid from second fluid inlet 230 to second fluid outlet 232. First-path passage 284 may be offset from first fluid inlet 220 (e.g., a solid non-permeable portion of slidable plate 282 may be axially aligned with the first fluid inlet 220), thereby restricting or preventing liquid from first fluid inlet 220.

Figure 16:
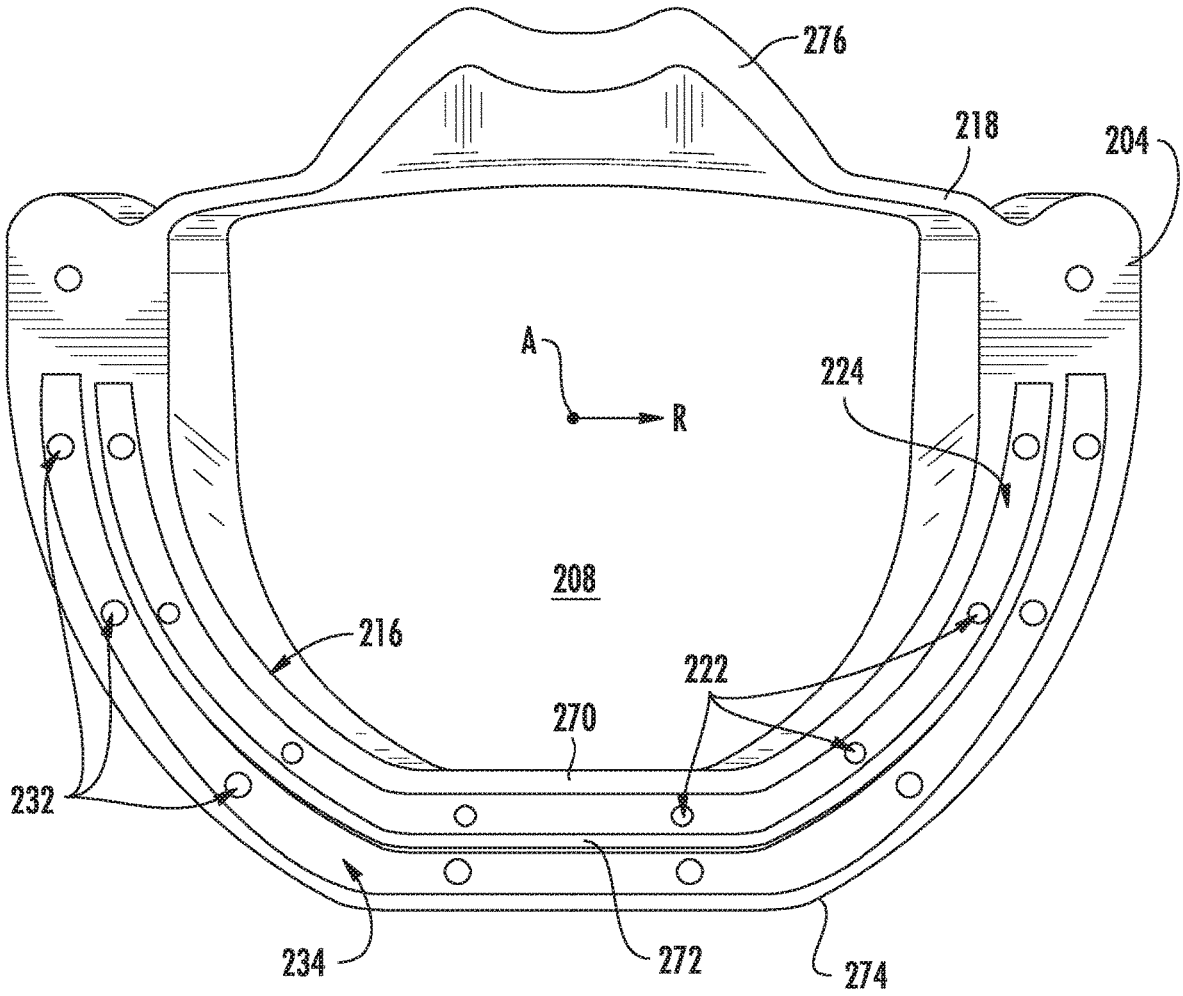
FIG. 16 provides a cross-sectional top view of a conduit portion of a dispenser assembly according to exemplary embodiments of the present disclosure.
Figure 17:
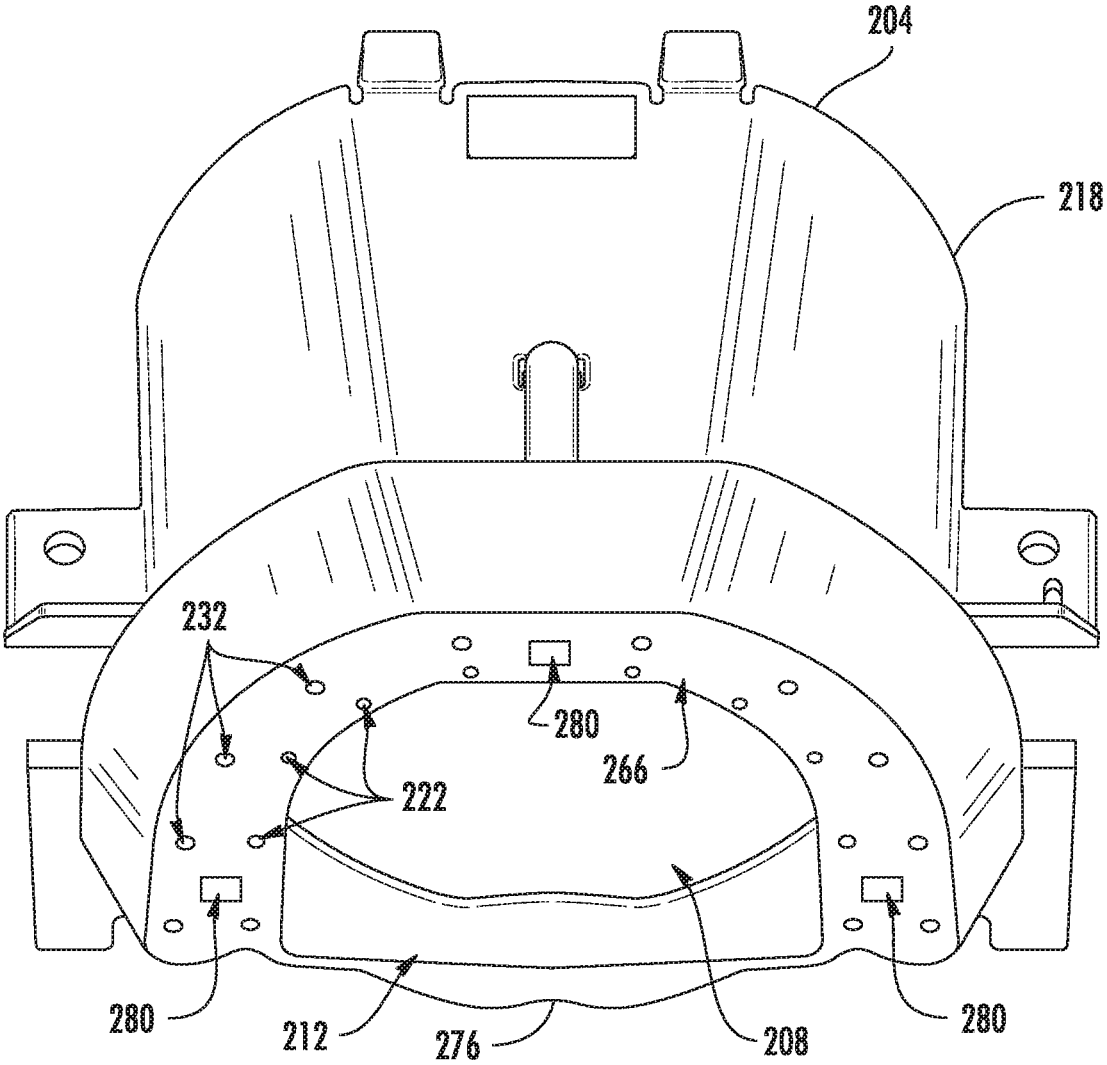
FIG. 17 provides a lower perspective view of the exemplary conduit portion of FIG. 16.
Figure 18:
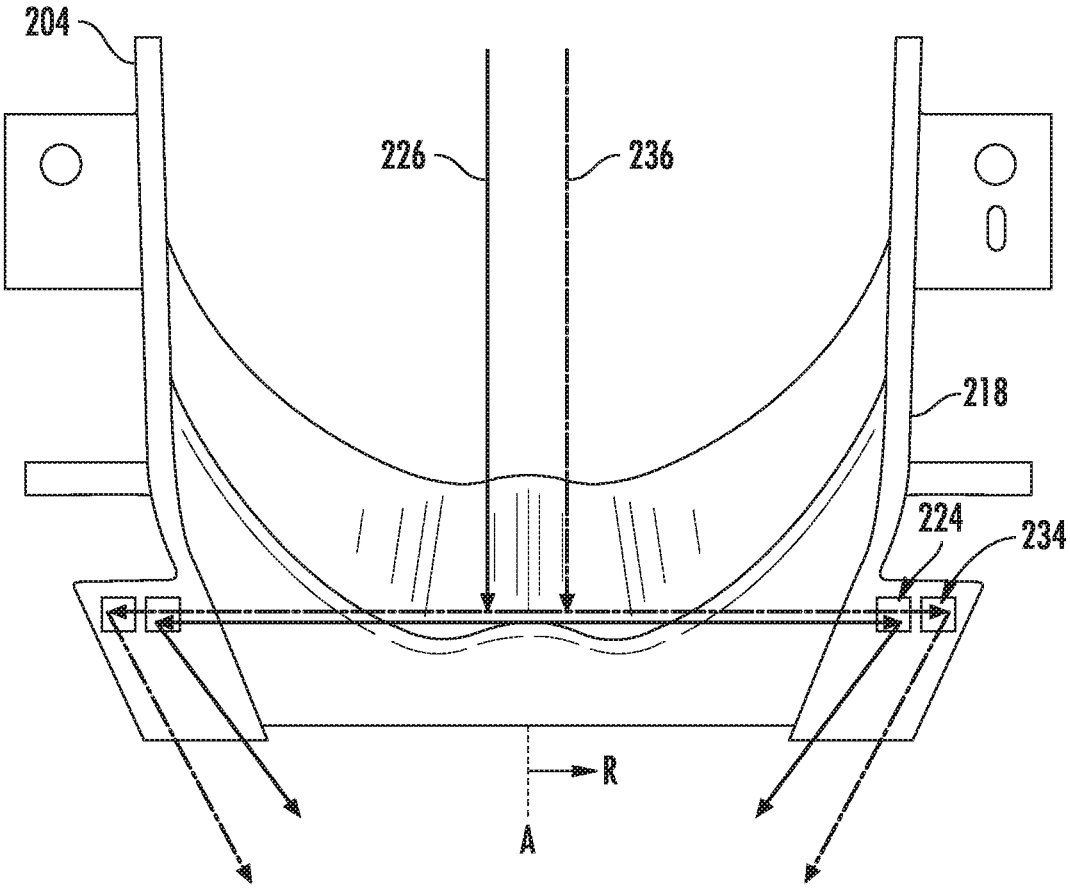
FIG. 18 provides a cross-sectional front view of the exemplary conduit portion of FIG. 16, illustrating multiple fluid flow paths through conduit portion.
Figure 19:
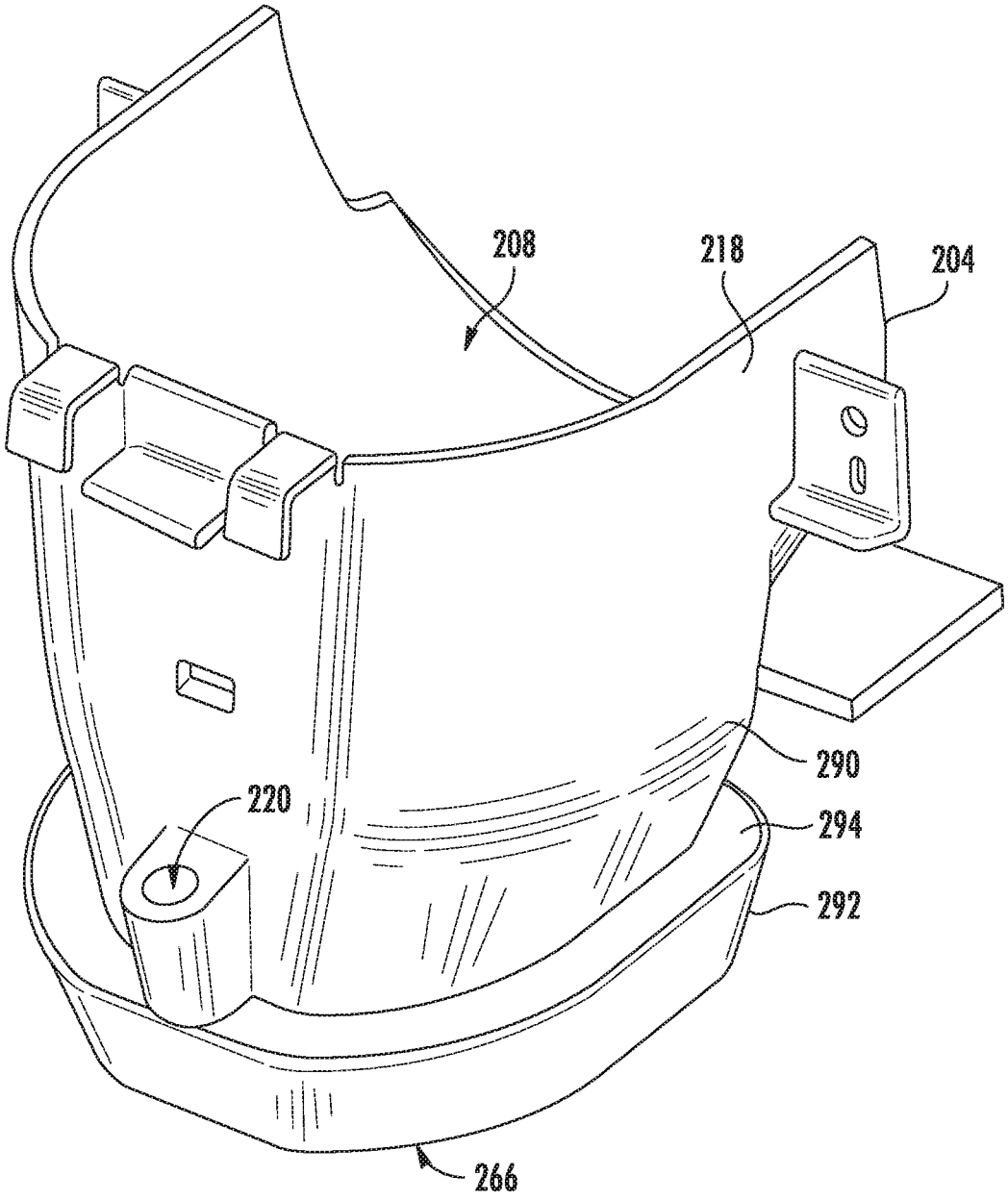
FIG. 19 provides a perspective view of a conduit portion of a dispenser assembly according to exemplary embodiments of the present disclosure.
Figure 20:
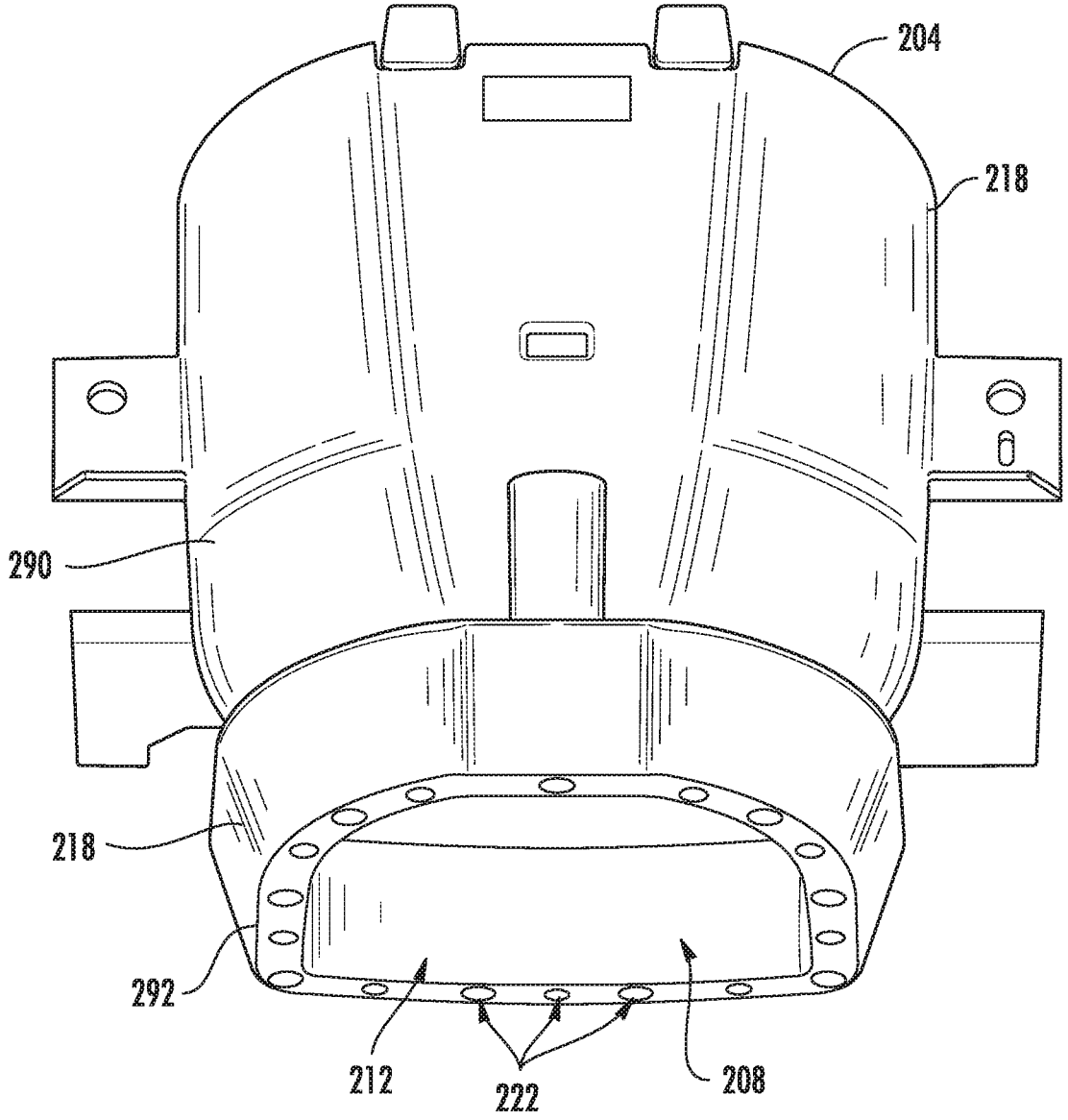
FIG. 20 provides a lower perspective view of the exemplary conduit portion of FIG. 19.
Figure 21:
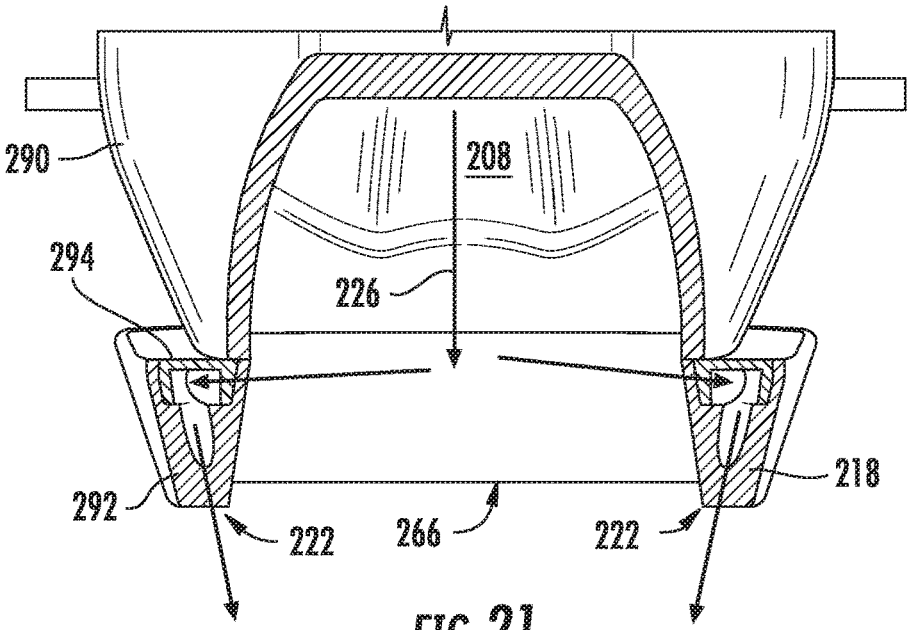
FIG. 21 provides a cross-sectional front view of the exemplary conduit portion of FIG. 19, illustrating multiple fluid flow paths through conduit portion.
Figure 22:
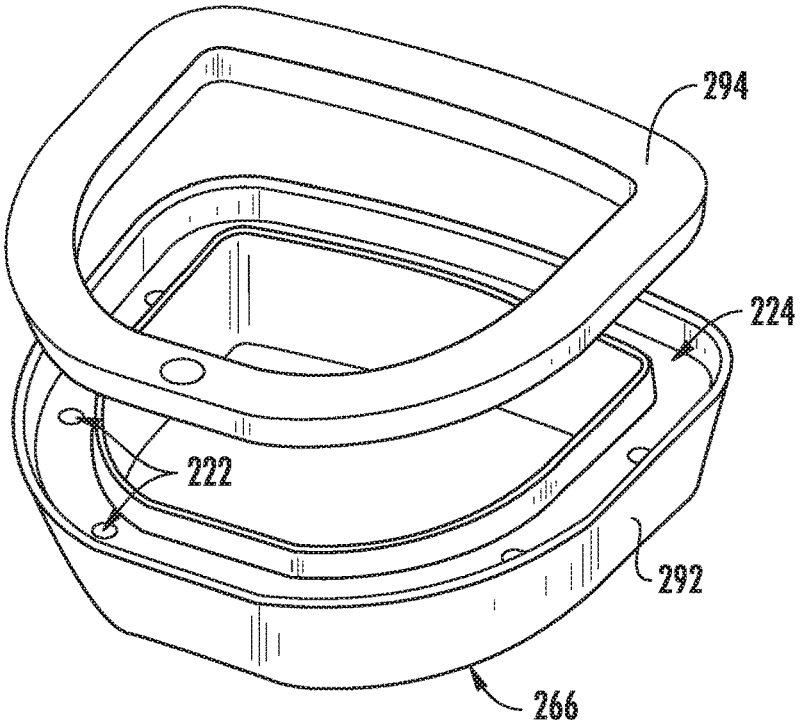
FIG. 22 provides an exploded perspective view of a portion of the exemplary conduit portion of FIG. 19.

Turning now to FIGS. 16 through 18, various views are provided of a conduit portion (e.g., bottom portion 204) for a dispenser conduit 200 according to exemplary embodiments. The exemplary embodiments of FIGS. 16 through 18 may be provided as, as part of, or in alternative to one or more of the exemplary embodiments of dispenser conduit 200, as described above. In turn, it is understood that the exemplary embodiments of FIGS. 16 through 18 may include all or some of the above-described features, except as otherwise indicated.

In some embodiments, a first manifold channel 224 is defined downstream from first fluid inlet 220 (i.e., in downstream fluid communication with first fluid inlet 220). In particular, first manifold channel 224 may be defined to extend within chute wall 218 between an internal radial partition 270 and an intermediate radial partition 272. Internal radial partition 270 may be positioned between ice passage 208 and first manifold channel 224 along the radial direction R while intermediate radial partition 272 is radially spaced apart (e.g., outward along the radial direction R) from internal radial partition 270 (e.g., in front of first manifold channel 224) along the radial direction R. As shown, first manifold channel 224 extends (at least partially) about ice passage 208. In the exemplary embodiments of FIGS. 16 through 18, first manifold channel 224 is formed as a U-shaped fluid passage disposed, for example, perpendicular to the axial direction A. Optionally, a mid-point or vertex of the shaped "U" may be positioned in front of ice passage 208. In some such embodiments, a solid rear wall segment 276 of chute wall 218 extends between the end points of the shaped "U" and encloses ice passage 208 (e.g., at a rearmost portion thereof). First fluid inlet 220 may generally extend to first manifold parallel to the axial direction A and intersect first manifold channel 224. In the illustrated embodiments of FIGS. 16 through 18, first fluid inlet 220 intersects first manifold channel 224 at a mid-point or vertex of the shaped "U."

In the exemplary embodiments of FIGS. 16 through 18, a plurality of discrete first fluid outlets 222 are defined through chute wall 218. Each first fluid outlet 222 may be downstream from first manifold channel 224 (i.e., in downstream fluid communication with first manifold channel 224 and first fluid inlet 220). Moreover, although the first fluid outlets 222 need not be in perfect geometric parallel to the axial direction A, each first fluid outlet 222 may generally extend along the axial direction A from first manifold channel 224 to a bottom lip 266 of chute wall 218. Optionally, the first fluid outlets 222 may be directed radially inward (e.g., at a non-parallel angle) toward axial direction A such that liquid flowing from the first fluid outlets 222 can converge at a location along the axial direction A that is below chute wall 218. In certain embodiments, the discrete first fluid outlets 222 are circumferentially spaced apart along first manifold channel 224. In other words, each discrete first fluid outlet 222 intersects first manifold channel 224 at a separate circumferential location of first manifold channel 224. Moreover, each first fluid outlet 222 may be defined in fluid parallel to the other first fluid outlets 222. During use, a liquid (e.g., water) may thus be selectively flowed through first fluid inlet 220 to first manifold channel 224. Within first manifold channel 224, some of the liquid may be flowed circumferentially and, thus, to each of the first fluid outlets 222. From the first fluid outlets 222, the liquid may be dispensed to the dispenser recess 150.

In some embodiments, a second fluid inlet 230 is defined on chute wall 218 in fluid isolation from ice passage 208—e.g., downstream from fluid source(s) 240, 242 (FIG. 6), as discussed above. Second fluid outlet 232 may further be defined in fluid parallel to first fluid inlet 220. Second fluid inlet 230 may be positioned radially outward from the ice passage 208 or axial direction A (e.g., adjacent to or spaced apart from first fluid inlet 220). Moreover, second fluid inlet 230 may be positioned above outlet 212 or a second fluid outlet 232. Additionally or alternatively, second fluid inlet 230 may be positioned at a front portion of chute wall 218.

In the exemplary embodiments of FIGS. 16 through 18, a second manifold channel 234 is defined downstream from second fluid inlet 230 (i.e., in downstream fluid communication with second fluid inlet 230). In particular, second manifold channel 234 may be defined to extend within chute wall 218 between intermediate radial partition 272 and an external radial partition 274. Intermediate radial partition 272 may be positioned between second manifold channel 234 and first manifold channel 224 along the radial direction R while external radial partition 274 is positioned between second manifold channel 234 and the ambient environment (e.g., in front of dispenser conduit 200) along the radial direction R. As shown, second manifold channel 234 extends (at least partially) about ice passage 208. In the exemplary embodiments of FIGS. 16 through 18, second manifold channel 234 is formed as a U-shaped fluid passage disposed, for example, perpendicular to the axial direction A. Optionally, second manifold channel 234 may be defined parallel to first manifold channel 224. Additional or alternatively, a mid-point or vertex of the shaped "U" may be positioned in front of ice passage 208 or first manifold channel 224. Second fluid inlet 230 may generally extend to second manifold parallel to the axial direction A and intersect second manifold channel 234. In the illustrated embodiments of FIGS. 16 through 18, second fluid inlet 230 intersects second manifold channel 234 at a mid-point or vertex of the shaped "U."

In certain embodiments, a plurality of discrete second fluid outlets 232 is defined through chute wall 218. Each second fluid outlet 232 may be downstream from second manifold channel 234 (i.e., in downstream fluid communication with second manifold channel 234 and second fluid inlet 230). Moreover, although the second fluid outlets 232 need not be in perfect geometric parallel to the axial direction A, each second fluid outlet 232 may generally extend along the axial direction A from second manifold channel 234 to a bottom lip 266 of chute wall 218. Optionally, the second fluid outlets 232 may be directed radially inward (e.g., at a non-parallel angle) toward the axial direction A such that liquid flowing from the second fluid outlets 232 can converge at a location along the axial direction A that is below chute wall 218. In certain embodiments, the discrete second fluid outlets 232 are circumferentially spaced apart along second manifold channel 234. In other words, each discrete second fluid outlet 232 intersects second manifold channel 234 at a separate circumferential location of second manifold channel 234. Moreover, each second fluid outlet 232 may be defined in fluid parallel to the other second fluid outlets 232. During use, a liquid (e.g., water) may thus be selectively flowed through second fluid inlet 230 to second manifold channel 234. Within second manifold channel 234, some of the liquid may be flowed circumferentially and, thus, to each of the second fluid outlets 232. From the second fluid outlets 232, the liquid may be dispensed to the dispenser recess 150.

In certain embodiments, one or more fluidly-isolated compartments 280 are defined within chute wall 218 to receive a light source 264 or proximity sensor 262 (FIG. 7). For instance, the compartments may be defined at a bottom lip 266 of chute wall 218 separate from fluid outlets 222, 232 and ice passage 208 (e.g., such that liquids or ice are not directed therethrough). One or more proximity sensors 262 or light sources 264 may be mounted within chute wall 218 (e.g., at a front portion thereof) and received within a fluidly-isolated compartment 280. When mounted, the proximity sensor 262 or light source 264 may be directed toward dispenser recess 150 (FIG. 5). In certain embodiments, a plurality of fluidly-isolated compartments 280 is defined within chute wall 218. As shown, each of the fluidly-isolated compartments 280 is spaced apart (e.g., circumferentially) from each other about the axial direction A or ice passage 208.

As described above, a multi-path valve 250 (FIG. 6) may be positioned in upstream fluid communication with the plurality of discrete first fluid outlets 222 and the second fluid outlets 232 (e.g., within a refrigerator door upstream from the fluid inlets 220, 230). A liquid may be selectively flowed through the first fluid path 226 or the second fluid path 236 (FIG. 6). During use, the multi-path valve 250 may thus alternately direct the fluid flow from the fluid source to the plurality of discrete first fluid outlets 222 and the plurality of discrete second fluid outlets 232.

Turning now to FIGS. 19 through 22, various views are provided of a conduit portion (e.g., bottom portion 204) for a dispenser conduit 200 according to exemplary embodiments. The exemplary embodiments of FIGS. 19 through 22 may be provided as, as part of, or in alternative to one or more of the exemplary embodiments of dispenser conduit 200, as described above. In turn, it is understood that the exemplary embodiments of FIGS. 19 through 22 may include all or some of the above-described features, except as otherwise indicated.

In some embodiments, dispenser conduit 200 includes a bottom portion 204 that is provided as multiple discrete segments. For instance, chute wall 218 of the bottom portion 204 may include at least two discrete segments. A top segment 290 may extend along ice passage 208 from upper portion 202 (FIG. 4) while a lower segment 292 is joined to top segment 290 (e.g., in a bottom end thereof via one or more suitable adhesives, ultrasonic welds, or mechanical fasteners). In some such embodiments, a first manifold channel 224 is defined within lower segment 292. Optionally, first manifold channel 224 extends about the entirety of ice passage 208 (e.g., perpendicular to the axial direction A). Thus, first manifold channel 224 may be provided as a continuous fluid channel surrounding ice passage 208. Additionally or alternatively, first fluid inlet 220 may be provided as a generally axial passage defined through top segment 290.

In certain embodiments, a plurality of discrete first fluid outlets 222 is defined through lower segment 292. Each first fluid outlet 222 may be downstream from first manifold channel 224 (i.e., in downstream fluid communication with first manifold channel 224 and first fluid inlet 220). Moreover, although the first fluid outlets 222 need not be in perfect geometric parallel to the axial direction A, each first fluid outlet 222 may generally extend along the axial direction A from first manifold channel 224 to a bottom lip 266 of chute wall 218. Optionally, the first fluid outlets 222 may be directed radially inward (e.g., at a non-parallel angle) toward axial direction A such that liquid flowing from the first fluid outlets 222 can converge at a location along the axial direction A that is below chute wall 218. In certain embodiments, the discrete first fluid outlets 222 are circumferentially spaced apart along first manifold channel 224. In other words, each discrete first fluid outlet 222 intersects first manifold channel 224 at a separate circumferential location of first manifold channel 224. Moreover, each first fluid outlet 222 may be defined in fluid parallel to the other first fluid outlets 222. During use, a liquid (e.g., water) may thus be selectively flowed through first fluid inlet 220 to first manifold channel 224. Within first manifold channel 224, some of the liquid may be flowed circumferentially and, thus, to each of the first fluid outlets 222. From the first fluid outlets 222, the liquid may be dispensed to the dispenser recess 150.

In additional or alternative embodiments, channel cap 294 is provided on lower segment 292. Channel cap 294 may be positioned over first manifold channel 224 (e.g., between first fluid inlet 220 and first manifold channel 224 along the axial direction A). Moreover, channel cap 294 may extend along first manifold channel 224 and about ice passage 208 such that channel cap 294 covers first manifold channel 224. Thus, when assembled channel cap 294 may prevent liquid from flowing above and out of first manifold channel 224.

Advantageously, the present disclosure provides for the dispensing of liquid without the need for a visible conduit extending in front of or behind a conduit for dispensing ice.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:
a cabinet;
an ice maker attached to the cabinet;
a dispenser recess defined on the refrigerator appliance in selective communication with the ice maker; and
a dispenser conduit disposed within the dispenser recess, the dispenser conduit comprising a chute wall defining an ice passage permitting ice therethrough,
a fluid inlet positioned radially outward from the ice passage in fluid communication with a fluid source selectively supplying a fluid flow thereto,
a manifold channel extending within the chute wall about at least a portion of the ice passage, the manifold channel being in downstream fluid communication with the fluid inlet,
a plurality of discrete first fluid outlets defined through the chute wall in downstream fluid communication with the manifold channel, the plurality of discrete first fluid outlets being circumferentially spaced apart along the manifold channel,
a second fluid inlet positioned radially outward from the ice passage in fluid parallel to the first fluid inlet, and
a second fluid outlet in downstream fluid communication with the second fluid inlet.

2. The refrigerator appliance of claim 1, further comprising a proximity sensor mounted within the chute wall, the proximity sensor being directed toward the dispenser recess.

3. The refrigerator appliance of claim 1, further comprising a light source mounted within the chute wall, the light source being directed toward the dispenser recess.

4. The refrigerator appliance of claim 3, further comprising a controller operably coupled to the light source, wherein the controller is configured to direct a color of the light source based on whether the fluid flow from the fluid source corresponds to at least one of a hot water source or a cold water source.

5. The refrigerator appliance of claim 1, further comprising a multi-path valve positioned in upstream fluid communication with the plurality of discrete first fluid outlets and the second fluid outlet to alternately direct the fluid flow from the fluid source to the plurality of discrete first fluid outlets and the second fluid outlet.

6. The refrigerator appliance of claim 5, wherein the multi-path valve is mounted upstream from the first and second fluid inlets.

7. The refrigerator appliance of claim 6, further comprising a controller operably coupled to the multi-path valve, wherein the controller is configured to selectively direct a flow path through the multi-path valve based on a determined container size.

8. A refrigerator appliance comprising:
a cabinet;
an ice maker attached to the cabinet;
a dispenser recess defined on the refrigerator appliance in selective communication with the ice maker;
a dispenser conduit disposed within the dispenser recess, the dispenser conduit comprising a chute wall defining an ice passage permitting ice therethrough,
a bottom lip extending around the ice passage,
a fluid inlet positioned radially outward from the ice passage in fluid communication with a fluid source selectively supplying a fluid flow thereto, and
a fluid outlet defined through the chute wall in downstream fluid communication with the fluid inlet; and
a light source mounted within the chute wall at the bottom lip, the light source being directed toward the dispenser recess.

9. The refrigerator appliance of claim 8, wherein the light source comprises a plurality of light emitting diodes spaced apart about the ice passage.

10. The refrigerator appliance of claim 8, further comprising a controller operably coupled to the light source, wherein the controller is configured to direct a color of the light source based on whether the fluid flow from the fluid source corresponds to at least one of a hot water source or a cold water source.

11. The refrigerator appliance of claim 8, wherein the fluid outlet is a first fluid outlet, wherein the fluid inlet is a first fluid inlet, and wherein the chute wall further defines
a second fluid inlet positioned radially outward from the ice passage in fluid parallel to the first fluid inlet, and
a second fluid outlet in downstream fluid communication with the second fluid inlet.

12. The refrigerator appliance of claim 11, further comprising a multi-path valve positioned in upstream fluid communication with the first fluid outlet and the second fluid outlet to alternately direct the fluid flow from the fluid source to the first fluid outlet and the second fluid outlet.

13. The refrigerator appliance of claim 12, further comprising a controller operably coupled to the multi-path valve, wherein the controller is configured to selectively direct a flow path through the multi-path valve based on a determined container size.

14. A refrigerator appliance comprising:
a cabinet;
an ice maker attached to the cabinet;
a dispenser recess defined on the refrigerator appliance in selective communication with the ice maker; and
a dispenser conduit disposed within the dispenser recess, the dispenser conduit comprising a chute wall defining an ice passage permitting ice therethrough,
a first fluid inlet positioned radially outward from the ice passage in fluid communication with a fluid source selectively supplying a fluid flow thereto,
a first fluid outlet defined through the chute wall in downstream fluid communication with the first fluid inlet,
a second fluid inlet positioned radially outward from the ice passage in fluid parallel to the first fluid inlet, and
a second fluid outlet in downstream fluid communication with the second fluid inlet.

15. The refrigerator appliance of claim 14, further comprising a proximity sensor mounted within the chute wall, the proximity sensor being directed toward the dispenser recess.

16. The refrigerator appliance of claim 14, further comprising a light source mounted within the chute wall, the light source being directed toward the dispenser recess.

17. The refrigerator appliance of claim 16, wherein the light source comprises a plurality of light emitting diodes spaced apart about the ice passage.

18. The refrigerator appliance of claim 14, wherein the first fluid outlet comprises a plurality of discrete first fluid outlets defined through the chute wall, wherein the second fluid outlet comprises a plurality of discrete second fluid outlets defined through the chute wall, and wherein the chute wall further defines a first manifold channel extending within the chute wall in upstream fluid communication with the plurality of discrete first fluid outlets, and a second manifold channel extending within the chute wall in upstream fluid communication with the plurality of discrete second fluid outlets and in fluid isolation from the first manifold channel.

19. The refrigerator appliance of claim 14, further comprising a multi-path valve positioned in upstream fluid communication with the first fluid outlet and the second fluid outlet to alternately direct the fluid flow from the fluid source to the first fluid outlet and the second fluid outlet.

20. The refrigerator appliance of claim 19, further comprising a controller operably coupled to the multi-path valve, wherein the controller is configured to selectively direct a flow path through the multi-path valve based on a determined container size.

* * * * *